US006631706B1

(12) United States Patent
Yamada et al.

(10) Patent No.: US 6,631,706 B1
(45) Date of Patent: Oct. 14, 2003

(54) HIGH PRESSURE FUEL SUPPLY PUMP FOR INTERNAL COMBUSTION ENGINE

(75) Inventors: Hiroyuki Yamada, Hitachinaka (JP); Shigenori Tahara, Hitachinaka (JP); Atsuji Saito, Hitachinaka (JP); Yukio Takahashi, Hitachinaka (JP); Masami Abe, Hitachi (JP)

(73) Assignees: Hitachi, Ltd., Tokyo (JP); Hitachi Car Engineering Co., Ltd., Ibaraki-ken (JP)

( * ) Notice: Subject to any disclaimer, the term of this patent is extended or adjusted under 35 U.S.C. 154(b) by 0 days.

(21) Appl. No.: 09/463,659

(22) PCT Filed: Jun. 19, 1999

(86) PCT No.: PCT/JP99/03257

§ 371 (c)(1),
(2), (4) Date: Jan. 28, 2000

(87) PCT Pub. No.: WO00/47888

PCT Pub. Date: Aug. 17, 2000

(30) Foreign Application Priority Data

Feb. 9, 1999 (JP) ..... 10-031619
May 11, 1999 (JP) ..... 10-129903

(51) Int. Cl.[7] ..... F02M 37/04
(52) U.S. Cl. ..... 123/495; 123/447
(58) Field of Search ..... 123/506, 299, 123/300, 496, 495, 447; 417/493

(56) References Cited

FOREIGN PATENT DOCUMENTS

| | | |
|---|---|---|
| JP | 47-76640 | 3/1974 |
| JP | 50-141499 | 4/1977 |
| JP | 57-193756 | 11/1982 |
| JP | 2-72279 | 3/1990 |
| JP | 2-118282 | 5/1990 |
| JP | 3-89085 | 4/1991 |
| JP | 5-172268 | 7/1993 |
| JP | 7-12029 | 1/1995 |
| JP | 8-68370 | 3/1996 |
| JP | 2690734 | 8/1997 |
| JP | 10-122414 | 5/1998 |
| JP | 10-141177 | 5/1998 |
| JP | 10-318068 | 12/1998 |
| JP | 10-318091 | 12/1998 |

*Primary Examiner*—Carl S. Miller
(74) *Attorney, Agent, or Firm*—Crowell & Moring LLP

(57) ABSTRACT

An intake valve automatically opened and closed by pressure of a pressuring chamber is provided in a fuel intake passage, the intake valve is pushed to open by a plunger of an electromagnetic plunger mechanism, pulling-in operating timing of the plunger is controlled according to the operating condition of an internal combustion engine, and opening time of the intake valve during compression stroke of a pump is controlled to make discharge flow-rate of high pressure fuel variable.

16 Claims, 14 Drawing Sheets

12 : PRESSURIZING CHAMBER
12a : MAIN PRESSURIZING CHAMBER
12b : SUB-PRESSURIZING CHAMBER

HIGH PRESSURE FUEL SUPPLY PUMP FOR INTERNAL COMBUSTION ENGINE

TECHNICAL FIELD

The present invention relates to a high pressure fuel supply pump, and particularly, to a high pressure fuel supply pump suitable for feeding under pressure high pressure fuel to a fuel injection valve of an internal combustion engine.

Further, the invention relates to a high-pressure fuel supply pump provided with a variable capacity mechanism for adjusting quantity of fuel discharged.

BACKGROUND ART

① In a conventional high pressure fuel supply pump, for example, as shown in Japanese Patent No. 2690734 Specification, fuel is supplied from a tank to a high pressure pump by a low pressure pump to increase its pressure to high, and is supplied to a common rail. Within the high pressure pump, an intake passage and a discharge passage are communicated with an upper end surface of a pressurizing chamber and an intermediate side wall of the pressurizing chamber, respectively.

Further, in the other conventional high pressure fuel supply pump, for example, as shown in Japanese Patent Application Laid-Open No. Hei10-318091 Publication, an intake passage and a discharge passage are communicated with an intermediate side wall or an upper end surface of a pressurizing chamber and an upper end surface of the pressurizing chamber, respectively.

Incidentally, when the engine is first started, or restarted after stoppage for a long period, vapor of air or fuel is present within a fuel pipe. Therefore, immediately after start, the pressure increasing characteristic of the high pressure pump is apt to be deteriorated. To prevent this, it is necessary to rapidly discharge air or fuel vapor within the pressurizing chamber of the high pressure pump to thereby secure the pressure increasing characteristic of the high pressure pump, and to rapidly supply fuel into the common rail by a low pressure pump of large discharge capacity.

However, in the high pressure fuel supply pump described in Japanese Patent No. 2690734 Specification, an intake passage and a discharge passage are provided on an upper end surface of a pressurizing chamber and an intermediate side wall of the pressurizing chamber, respectively, thus posing a problem in that in the intake stroke, vapor or the like is hard to be discharged on the intake passage side due to the intake fuel, and in the discharge stroke, the vapor or the like is apt to remain within the pressurizing chamber above the discharge passage, thereby lowering the supply property of fuel.

Also in the constitution described in FIG. 5 of Japanese Patent Application Laid-Open No. Hei10-318091 Publication, a discharge passage within the high pressure pump is provided in an upper end of a pressurizing chamber, and therefore, vapor within the pressurizing chamber is apt to be discharged. However, both the above-described prior arts have a problem in that since fuel fed from the low pressure pump is communicated with the pressurizing chamber which changes in volume due to piston motion within the high pressure pump, even if an attempt is made to supply fuel to the common rail by the low pressure pump immediately after the engine starts, the piston motion within the pressurizing chamber makes resistance to delay a supply of fuel.

Further, in the conventional constitution described in FIG. 1 of Japanese Patent Application Laid-Open No. Hei10-318091 Publication, since an upper flat surface of a cylinder fixing portion is compressed and fitted, fuel flows into the outer periphery of a delivery valve passing through the outer circumference of a cylinder when the intake passage is communicated with the intermediate side wall of the pressurizing chamber, because of which, an O-ring is provided for sealing from outside. However, this poses a problem in that when an O-ring is formed from an elastic member, it moves due to the pressure variation in the pressuring chamber, and therefore, pressure rising of the pressurizing chamber reduces, or rubbing wear or rupture of the O-ring occurs.

② Further, with respect to a seal mechanism against a leakage of high pressure fuel, in the conventional high pressure fuel supply pump, fuel in the pressurizing chamber is increased to high pressure by reciprocating movement of a plunger. Here, since fuel pressure pressurized is considerably high pressure, fuel possibly leaks out of a clearance between the plunger and the cylinder.

In view of the foregoing, in the conventional high pressure fuel supply pump, a seal material of an elastic member is disposed on the end of a sliding portion of a plunger, as described in Japanese Patent Application Laid-Open No. Hei 10-318068 Publication and Japanese Patent Application Laid-Open No. Hei8-368370 Publication, to prevent a leakage of fuel. On the fuel chamber side of the seal material is provided with a passage communicated with a fuel tank which is substantially at atmospheric pressure. Further, a sliding portion of the plunger is provided therein with a fuel reservoir leading to a fuel intake port which is a low pressure portion. By the provision of these constitutions noted above, when one end of the seal material is in contact with the atmospheric pressure, the other end is also communicated with the fuel tank to be substantially atmospheric pressure so as not to apply high pressure of the pressurizing chamber onto the seal material directly, thus preventing a leakage of fuel from the seal material.

However, the high pressure fuel supply pump described in FIG. 1 of Japanese Patent Application Laid-Open No. Hei 10-318068 Publication poses a problem in that since the distance from the fuel reservoir (a pulsation reducing space in FIG. 1) in communication with the low pressure fuel chamber to the sliding end of the plunger is short, when the seal material is broken or fallen off, a large quantity of fuel possibly flows outside from a clearance of the plunger sliding portion.

On the other hand, in the high pressure fuel supply pump described in FIG. 1 of Japanese Patent Application Laid-Open No. Hei 8-368370 Publication, since the distance from the fuel reservoir (a sliding hole 11*a* of a cylinder 11 in FIG. 1) in communication with the low pressure fuel chamber to the sliding end of the plunger is long, it is possible to make small the quantity of fuel which flows out when the seal material is broken or fallen off. However, since the sliding distance of the plunger from the pressurizing chamber to the fuel reservoir cannot be made long, thus posing a problem in that when pressurized, fuel leaks into the low pressure portion from a clearance of the sliding portion of the plunder to deteriorate the discharge efficiency.

Further, in the high pressure fuel supply pump described in FIG. 1 of Japanese Patent Application Laid-Open No. Hei 8-368370 Publication, the distance from the pressurizing chamber to the fuel reservoir is prolonged to thereby enable prevention of a leakage of fuel, but it is necessary, to this end, to prolong the full length of the sliding portion, thus posing a problem in that the whole pump becomes large in size.

Further, in the conventional high pressure fuel supply pumps described in Japanese Patent Application Laid-Open No. Hei 10-318068 and No. Hei 8-368370, since both ends of the seal material are made substantially at atmospheric pressure, it is necessary to provide, on the fuel chamber side of the seal material, a passage in communication with the fuel tank substantially at atmospheric pressure, thus making it necessary to have a passage for connecting the pump to the fuel tank. As a result, there was a problem in that processing of a pump becomes complicated, and a piping for connecting the pump to the tank is necessary, thus increasing the cost.

③ Next, with respect to the variable capacity mechanism, an apparatus heretofore known has the constitution wherein, for example, as described in Japanese Patent No. 2690734, an electromagnetic valve is provided within an intake passage, and a returning quantity to the intake side is controlled by opening and closing operation of the electromagnetic valve to thereby adjust the discharge quantity.

Further, the constitution is known for example, from Japanese Patent Application Laid-Open No. Hei 10-153157, wherein a check valve is provided within an intake passage, and a spill (overflow) valve is provided in a fuel spill (overflow) passage in communication with a pressurizing chamber whereby quantity of fuel spill to a fuel tank is controlled by opening and closing the spill valve to thereby adjust the discharge quantity.

Since rotation of a pump increases by a multiple of a cam of the pump with respect to the number of revolutions of the engine, it is necessary to open and close the intake valve or the spill valve in order of msec (millisecond). However, in such a state of high speed opening and closing, mass of the electromagnetic valve influences on the respondence.

DISCLOSURE OF INVENTION

A first object of the present invention is to provide a high pressure fuel supply pump capable of enhancing fuel supply property to a common rail immediately after start of an engine.

A second object of the present invention is to provide a high pressure fuel supply pump capable of enhancing pressure increasing property to a common rail immediately after start of an engine.

A third object of the present invention is to provide a high pressure fuel supply pump which suppresses an external leakage of fuel to a small quantity, even when a seal material of a sliding portion is broken or fallen off, and which is small in size and cheap.

A fourth object of the present invention is to provide a high pressure fuel supply pump having a variable capacity mechanism which is excellent in opening and closing respondence.

(1) For achieving the aforementioned first object, the present invention provides a high pressure fuel supply pump for pressurizing fuel supplied from an intake passage of fuel by a pressurizing member to feed it under pressure to a discharge passage, wherein in addition to a main pressurizing chamber in which said pressurizing member is arranged, a sub-pressurizing chamber for communication between said intake passage and said discharge passage is provided.

With the above constitution, fuel supplied from an intake passage by a low pressure pump can be supplied to a common rail via a discharge passage without being impeded by resistance caused by motion of a pressurizing member of a high pressure pump, thus enabling enhancement of fuel supply property to the common rail.

(2) In the above-described (1), preferably, said intake passage and said discharge passage are placed in communication with an upper end portion of said pressurizing chamber.

With the above constitution, in the discharge stroke, discharging of air and fuel vapor in the pressurizing chamber can be carried out securely, and a dead volume of the pressurizing chamber (a volume of the pressurizing chamber at the top dead center) can be minimized without impairing a fuel supply to the pressurizing chamber, thus enabling miniaturization of the high pressure pump.

(3) In the above-described (1), preferably, said sub-pressurizing chamber is arranged substantially annularly on the outer periphery of said main pressurizing chamber.

(4) For achieving the aforementioned second object, the present invention provides a high pressure fuel supply pump for pressurizing fuel supplied from an intake passage of fuel by a pressurizing member to feed it under pressure to a discharge passage, comprising a pressurizing chamber forming member having a tapered surface on the end and formed from a member separately from a pump body, said tapered surface of the pressurizing chamber forming member being compressed and fitted by a fixing member to thereby form said pressurizing chamber.

With the above constitution, the pressurizing chamber forming member can be fixed without providing an elastic member such as rubber, thus enabling enhancement of pressure increasing property to the common rail.

(5) For achieving the aforementioned third object, the present invention provides a high pressure fuel supply pump having an intake passage of fuel, a pressurizing chamber in communication with a discharge passage, and a pressurizing member for feeding under pressure fuel within said pressurizing chamber to said discharge passage, comprising: a seal material arranged on a sliding portion of said pressurizing member, a connecting passage for communicating the fuel chamber side of said seal material with the intake passage of fuel, and a check valve for impeding entry of fuel into said seal material side from said fuel intake passage side.

With the aforementioned constitution, even if the seal material is broken or the like, a leakage of fuel due to the check valve can be prevented, and by providing no portion in communication with the atmospheric, miniaturization and reduction in cost can be achieved.

(6) In the aforementioned (5), preferably, said check valve is opened when operation of a pump is stopped.

With the above constitution, it is possible to prevent the check valve when the pump is stopped from being adhered to the seat surface.

(7) In the aforementioned (6), preferably, said check valve is formed from an elastic member.

(8) The fourth object of the present invention is achieved by providing a high pressure pump comprising a valve body for opening and closing a fuel through-hole provided between a cylinder and a low pressure side passage, a spring for biasing said valve body in a closing direction with respect to said through-hole, an operating rod in contact with or spaced from said valve body to adjust opening and closing timing of said valve body, and an electromagnetic mechanism for driving the operating rod electromagnetically in association with the operating condition of the internal combustion engine.

In the present invention constructed as described above, since mass of the valve body will not be a load with respect to the electromagnetic driving mechanism, the respondence of the discharge capacity control mechanism is improved.

(9) In the aforementioned (8), the electromagnetic driving mechanism can be used in common with the intake valve mechanism.

(10) In the aforementioned (8), the electromagnetic driving mechanism can be constituted as a spill (overflow) valve mechanism.

(11) Further, preferred embodiments of the present invention are as follows:

An intake valve is provided on the intake passage, and to the intake valve is applied a small biasing force in a closing direction to a degree that automatically opens when fuel flows into the pressurizing chamber. Further, an engaging member having a biasing force for holding in an opening direction is engaged with the intake valve, and the engaging member controls the intake valve to open and close according to operating timing of an actuator.

Thereby, in the intake stroke of the pump, the intake valve can be opened irrespective of the operation of the actuator. Also in the compression stroke, since the intake valve maintains its open state unless the actuator is operated (ON), surplus fuel in the pressurizing chamber reduced as a result of the compression is returned to the intake side. Accordingly, since pressure of the pressurizing chamber is not risen, fuel is not fed under pressure to the discharge passage. In this state, when the actuator is operated (ON), the intake valve is closed by self-closing force so that pressure of the pressurizing chamber increases and the fuel is fed under pressure to the discharge passage. In this manner, the discharge quantity can be adjusted by controlling the operating timing of the actuator.

Upon maximum discharging, the ON state of the actuator is maintained whereby the intake valve is automatically opened and closed in synchronism with pressure of the pressurizing chamber, and therefore, the maximum discharge can be carried out without depending on the respondence of the actuator.

Further, upon low discharging, the actuator is turned ON from the latter half of the compression stroke and turned OFF till the termination of the intake stroke, and therefore, the high respondence is not necessary.

Furthermore, at the time of discharge, only the intake valve is required to close, and therefore, a leakage of fuel from the seat can be reduced.

(12) Preferably, if an electromagnetic type actuator is employed, control can be made simply by an engine control unit. Further, a fuel injection valve can also be used for the actuator.

(13) Further, preferably, an engaging portion between an intake valve and an engaging member is made in the form of a concavo-convex engagement, whereby deviation, slipping out or the like of the engaging portion can be prevented to secure positive operation.

(14) Further, preferably, a ball valve is used for the intake vale or the discharge valve, whereby the processing accuracy of the seat portion can be readily enhanced. Further, a cylindrical member is engaged with the ball valve, and the outer circumference of the cylindrical member is held capable of being reciprocated and slidably moved within the intake passage, so that the oscillation of the ball valve can be prevented. Further, since the cylindrical member is separated from the ball valve, both of them can be fabricated in an easy method.

(15) Further, preferably, in a plunger reciprocating and sliding type pump, a sliding portion of a plunger is made to be a cylindrical member separately from a pump body, whereby only the sliding member can be formed of a material suitable for sliding movement. Further, an inner wall of the cylindrical member is formed with a sliding hole of a plunger and an expanded inner wall portion having a larger inside diameter than the former, and only the outer peripheral portion of the diffused inner wall can be pressed and fitted in the pump body whereby preventing the sliding hole from being deformed. Accordingly, it is not necessary to re-process the sliding hole after fitting the cylindrical member, enabling fabrication at low cost.

(16) Further, preferably, a clearance is provided at a position other than the portion in which the cylindrical member is fitted in the pump body, an annular passage is formed on the outer peripheral portion of the cylindrical member, and the annular passage is made to communicate with one end of the plunger sliding hole and a fuel introducing passage, whereby fuel introducing pressure is guided into the annular passage to reduce a pressure difference relative to the pressurizing chamber, and thus enabling reduction in leakage quantity of fuel when passing through the fitting portion and the sliding portion from the pressurizing chamber. Further, since the fuel covers the outer circumference of the sliding portion, it is possible to cool the sliding portion.

(17) Moreover, preferably, a member in engagement with the pump body and the cylindrical member is provided in the fuel passage whereby the cylindrical member can be prevented from falling off while preventing a leakage of fuel from the engaging portion to the outside the pump or occurrence thereof.

BEST MODE FOR CARRYING OUT THE INVENTION

The constitution of a high pressure fuel supply pump according to a first embodiment of the present invention will be described hereinafter with reference to FIGS. 1 to 3.

Figure 1:
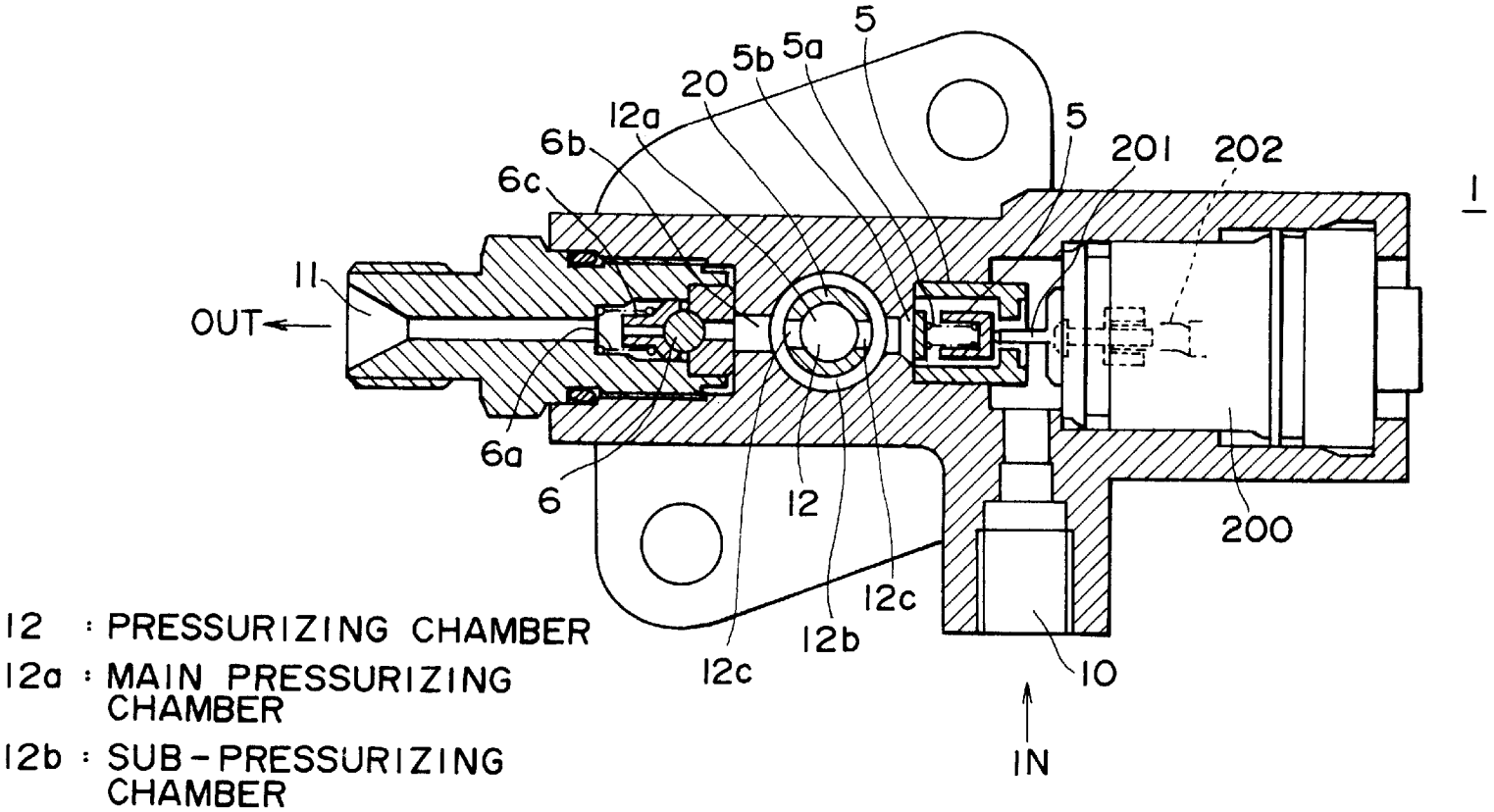
FIG. 1 is a horizontal sectional view of a high pressure fuel supply pump according to a first embodiment of the present invention.
Figure 2:
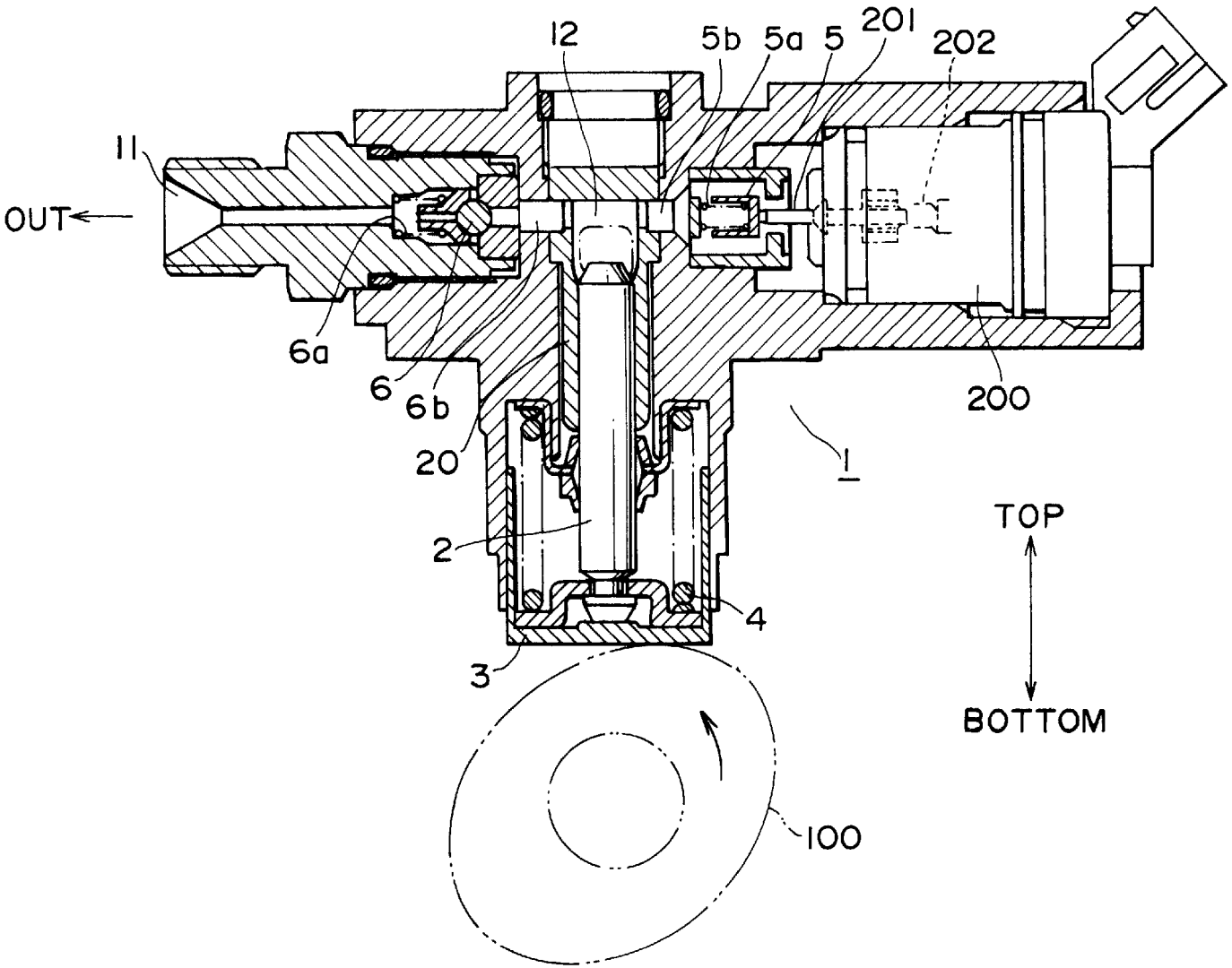
FIG. 2 is a vertical sectional view of a high pressure fuel supply pump according to a first embodiment of the present invention.
Figure 3:
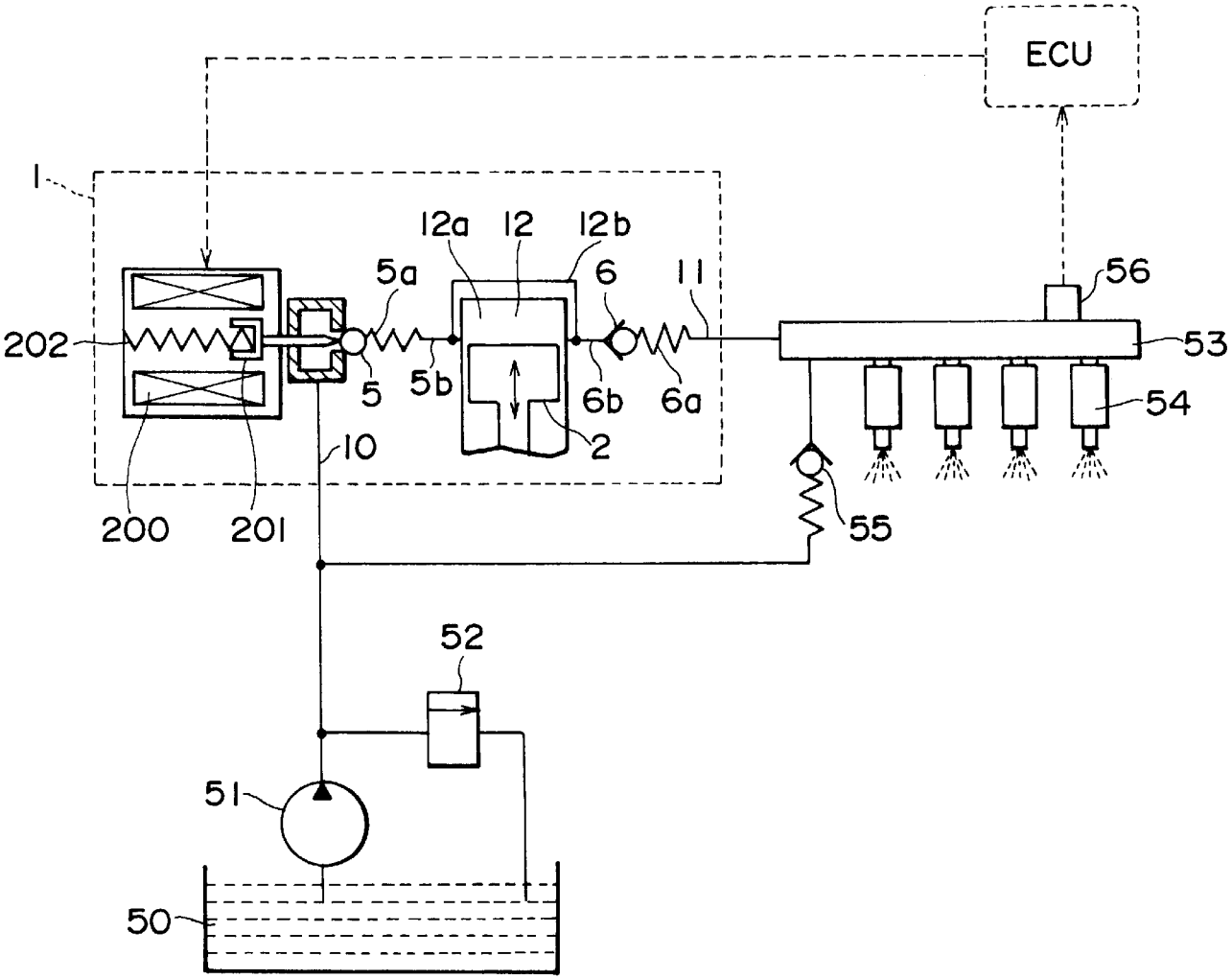
FIG. 3 is a system constituent view of a fuel injection system using a high pressure fuel supply pump according to a first embodiment of the present invention.

FIG. 1 is a horizontal sectional view of a high pressure fuel supply pump according to the present embodiment, FIG. 2 is a vertical sectional view of a high pressure fuel supply pump according to the present embodiment, and FIG. 3 is a system constituent view of a fuel injection system using a high pressure fuel supply pump according to the present embodiment. Note that in the drawings, the same reference numerals indicate the same parts.

As shown in FIG. 1, a pump body 1 comprises a fuel intake passage 10, a discharge passage 11, and a pressurizing chamber 12. The intake passage 10 is provided with an intake valve 5 in the form of a check valve which is held in one direction by a spring 5*a* to limit a flowing direction of fuel from the fuel intake passage 10 to a fuel intake passage 5*b*. The discharge passage 11 is provided with a discharge valve 6 in the form of a check valve which is held in one direction by a spring 6*a* to limit a flowing direction of fuel from a fuel discharge passage 6*b* to the fuel discharge passage 11.

In the present embodiment, the pressurizing chamber 12 is divided into a main pressurizing chamber 12*a* and an annular sub-pressurizing chamber 12*b* positioned on the outer periphery thereof, which are communicated by a communication hole 12*c* to each other. The sub-pressurizing chamber 12*b* is provided for communication between the fuel intake passage 5*b* and the fuel discharge passage 6*b*.

As shown in FIG. 2, a plunger 2 as a pressurizing member is held slidably in the main pressurizing chamber 12*a* of the pressurizing chamber 12. A lifter 3 provided on the lower end of the plunger 2 is pressed against a cam 100 by means of a spring 4. The plunger 2 is reciprocated by the cam 100 rotated by an engine cam shaft or the like to change capacity in the pressurizing chamber 12. When the intake valve 5 is closed during the compression stroke of the plunger 2, pressure in the pressurizing chamber 12 rises whereby the discharge valve 6 is automatically opened to feed fuel under pressure to a common rail 53. While the intake valve 5 is automatically opened when pressure of the pressurizing chamber 12 gets lower than that of a fuel introducing port, closing valve operation thereof is decided by operation of a solenoid 200.

The solenoid 200 is mounted in the pump body 1. An engaging member 201 and a spring 202 are provided on the solenoid 200. When the solenoid 200 is turned OFF, the engaging member 201 is biased in a direction of opening the intake valve 5 by means of a spring 202. The biasing force of the spring 202 is greater than that of the intake valve spring 5*a*, so that when the solenoid 200 is turned OFF, the intake valve 5 is in the open state, as shown in FIGS. 1 and 2.

Energization to the solenoid 200 is controlled so that where high pressure fuel is supplied from the pump body 1, the solenoid 200 assumes an ON (energization) state, and where a supply of fuel is stopped, the solenoid 200 assumes an OFF (deenergization) state.

When the solenoid 200 maintains the ON (energization) state, electromagnetic force greater than the biasing force of the spring 202 is generated to draw the engaging member 201 towards the solenoid 202, and therefore, the engaging member 201 is separated from the intake valve 5. In this state, the intake valve 5 serves as an automatic valve which is opened and closed in synchronism with reciprocating motion of the plunger 2. Accordingly, during the compression stroke, the intake valve 5 is closed, and fuel for a portion reduced in capacity of the pressurizing chamber 12 pushes to open the discharge valve 6 and is fed under pressure to the common rail 53.

On the other hand, when the solenoid 200 maintains an OFF (deenergization) state, the engaging member 201 is engaged with the intake valve 5 by the biasing force of the spring 202 to hold the intake valve 5 in an open state. Accordingly, also in the compression stroke, pressure of the pressurizing chamber 12 maintains a low pressure state substantially equal to that of the fuel introducing port, and therefore, the discharge valve 6 cannot be opened, and fuel for a portion reduced in capacity of the pressurizing chamber 12 is returned toward the fuel introducing port passing through the intake valve 5.

If the solenoid 200 is turned into the ON state in the midst of the compression stroke, fuel is fed under pressure to the common rail 53 from that time on. If the pressure feeding once starts, pressure in the pressurizing chamber 12 rises, and therefore, even if the solenoid 200 is turned into the OFF state later, the intake valve 5 maintains its closed state and the intake stroke is synchronized with the beginning to automatically open the valve.

The system constitution of a fuel supply system using a high pressure fuel supply pump according to the present embodiment will be described hereinafter with reference to FIG. 3.

Fuel in a tank 50 is guided to a fuel supply port 10 of the pump body 1 by a low pressure pump 51. Pressure of fuel guided to the fuel supply port 10 is regulated so as to have a fixed pressure by means of a pressure regulator 52. Fuel supplied to the pump body 1 is pressurized by the pump body 1 and fed under pressure from a fuel discharge port 11 to the common rail 53. Mounted on the common rail 53 are an injector 54, a relief valve 55, and a pressure sensor 56. The injector 54 is mounted while adjusting its number with the number of cylinders of the engine, and injects at the timing and quantity according to a fuel injection control signal of an engine control unit ECU. The relief valve 55 opens when pressure in the common rail 53 exceeds a fixed value to prevent a breakage of piping system.

When the engine starts first time or stops for a long period of time, air or fuel vapor is present in the fuel piping (including the interior of a high pressure pump and a common rail). Therefore, when the engine is started, it is necessary to rapidly fill the common rail 53 with fuel.

With respect to this point, in the present embodiment, the pressurizing chamber 12 comprises the main pressurizing chamber 12*a* for pressurizing fuel by reciprocation of the plunger 2, and the sub-pressurizing chamber 12*b* for communication between the fuel intake passage 5*b* and the fuel discharge passage 6*b*, as described above.

Accordingly, even if the plunger 2 is stopped at the top dead center and slidably moved, a sufficient passage can be formed between the intake passage 5*b* and the discharge passage 6*b* by the sub-pressurizing chamber 12*b*. Therefore, fuel can be fed under low pressure to the common rail 53 by the low pressure pump 51 before the high pressure pump starts feeding fuel under high pressure, and the common rail 53 can be filled with fuel momentarily. When the engine starts as mentioned above, pressure in the common rail 53 is close to the atmospheric pressure, and therefore, even if fuel pressure of the fuel discharge port 6*b* is in the state of discharge pressure of the low pressure fuel pump 51, the discharge valve 6 opens so that fuel flows from the fuel discharge port 6 to the fuel discharge port 11, and fuel can be supplied to the common rail 53.

Further, when fuel in the piping is supplied to the common rail 53 by the low pressure pump 61 whose discharge capacity is high, air and vapor can be fed under pressure to the common rail at the same time.

Further, in the present embodiment, the fuel intake passage 5*b* and the fuel discharge passage 6*b* are communicated with the upper end side wall, and no vapor reservoir is provided in the pressurizing chamber 12, as shown in FIG. 2. Therefore, vapor or the like is fed under pressure from the discharge passage 6*b* to the common rail 53 side and is not stayed in the pressurizing chamber 12. Accordingly, the pressurizing chamber is momentarily filled with fuel, making it possible to feed fuel under high pressure, it is possible to securely discharge air and fuel vapor within the pressurizing chamber.

Further, when the plunger 2 is positioned at the top dead center, the intake passage 5*b* and the discharge passage 6*b* are not blocked merely by providing an adequate clearance (1 to 2 mm) to prevent interference between the upper end of the plunger 2 and the upper surface of the pressurizing chamber 12, because of which, the dead volume of the pressurizing chamber (the volume of the pressurizing chamber at the top dead center) can be minimized without impairing a supply of fuel to the pressurizing chamber, enabling miniaturization of a pump.

As described above, according to the present embodiment, since when the engine starts or the like, low pressure fuel can be supplied to the common rail without impairing piston motion of the high pressure pump, the fuel supply property to the common rail immediately after start of engine can be improved.

The constitution of a high pressure fuel supply pump according to a second embodiment of the present invention will be described hereinafter with reference to FIGS. 4 and 5.

Figure 4:
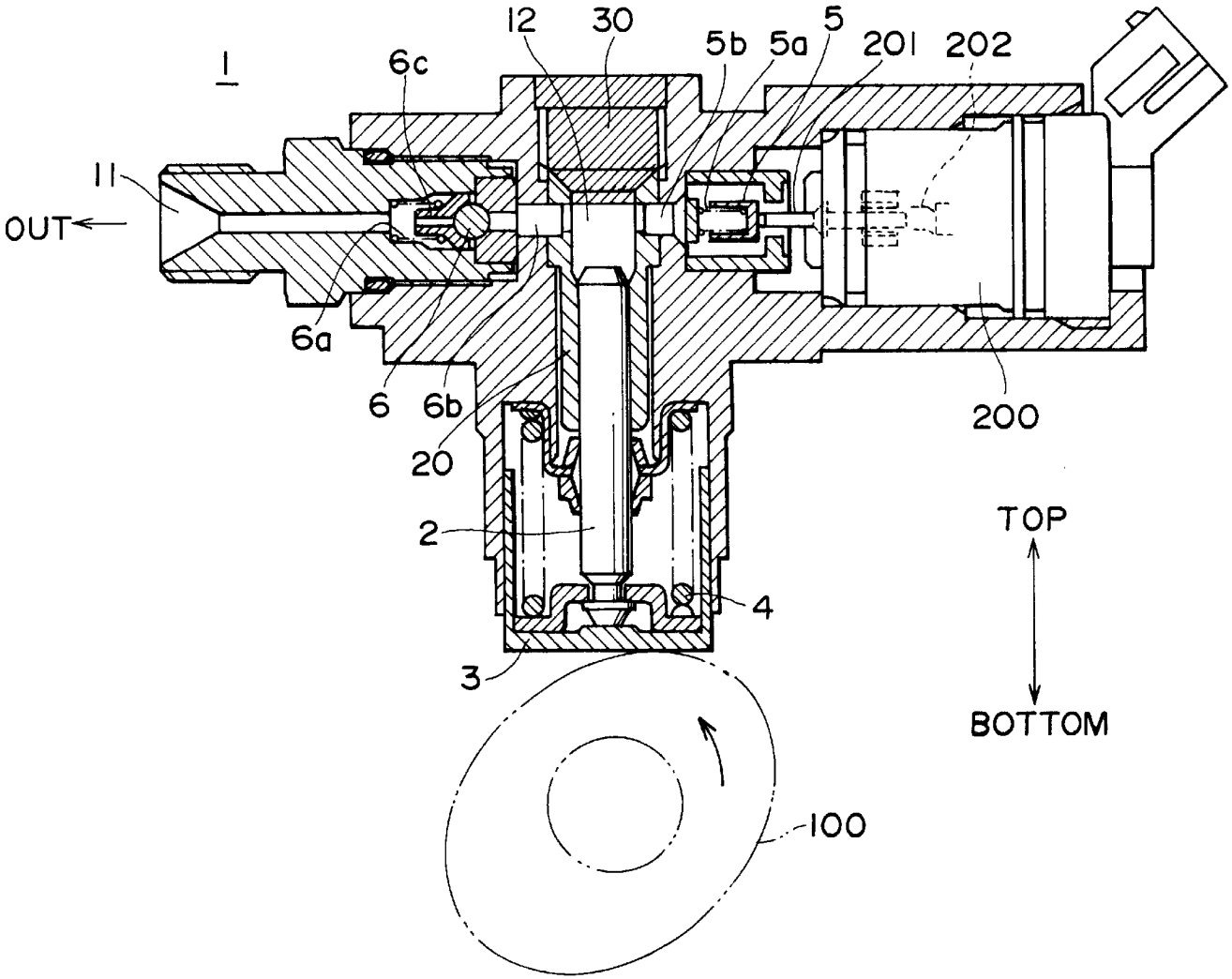
FIG. 4 is a vertical sectional view of a high pressure fuel supply pump according to a second embodiment of the present invention.
Figure 5:
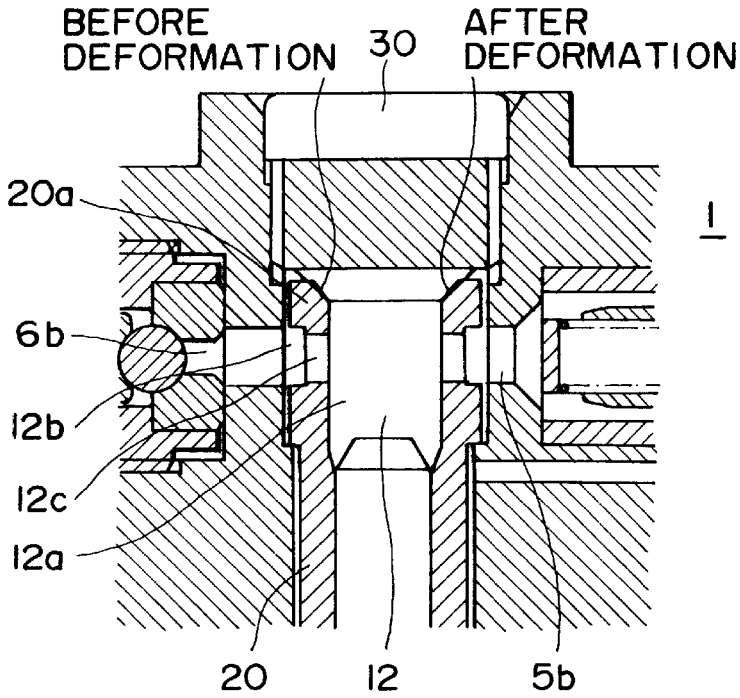
FIG. 5 is a partial enlarged view of FIG. 4.

FIG. 4 is a vertical sectional view of a high pressure fuel supply pump according to the present embodiment, and FIG. 5 is a partial enlarged view of FIG. 4. In FIGS. 4 and 5, the same reference numerals as those of FIGS. 1 to 3 indicate the same parts.

Also in the present embodiment, the pressurizing chamber 12 is provided with the main pressurizing chamber 12*a* and the sub-pressurizing chamber 12*b*. The feature of the present embodiment comprises a method of forming the pressurizing chamber 12.

The pressurizing chamber 12 is formed with a cylinder 20 having a sliding portion of a plunger 2 and being a pressurizing chamber forming portion as well, and a fixing member 30 for fixing the cylinder 20. The inner surface of an upper end portion 20*a* of the cylinder 20 is in a tapered shape, at which the fixing member 30 compresses and holds, whereby the upper end portion 20*a* is deformed outward and fitted in the pump body 1, as shown in FIG. 5, from a state (before deformation) to a state (after changed). Thereby, the pressurizing chamber 12, the intake passage 5*b* and the discharge passage 6*b* are isolated from the outside the pump by the upper end portion 20*a* of the cylinder, and therefore, a pressurizing chamber can be formed without using an elastic member such as rubber.

Accordingly, since an elastic member is not used as in the prior art, no change in volume of the pressurizing chamber caused by movement of the elastic member occurs, even if the pressure in the pressurizing chamber changes and the pressure increasing characteristic of the pump is not lowered.

Further, even if an O-ring is disposed, as a backup of seal, on the outer periphery of the fixing member 30, variation in pressure of the pressurizing chamber is not applied to the O-ring directly since a clearance between the outer circumference of the upper end portion 20*a* of the cylinder and the pump body 1 is very small, thus no rubbing wear or rupture occurs in the O-ring.

Further, even if members which are different in linear expansion coefficient are used for the body 1 and the cylinder 20 and even if the upper end portion of the cylinder is tightened up due to thermal contraction, the amount of deformation is scarce since the upper end portion of the cylinder is held by the fixing member 30 and high in rigidity, and no galling or the like due to the deformation of a sliding hole of the plunger 2 occurs.

As described above, according to the present embodiment, since low pressure fuel can be supplied to the common rail without impairing piston motion of the high pressure pump when the engine starts, the fuel supply property to the common rail immediately after start of the engine can be improved, and the pressure increasing characteristic of the high pressure fuel supply pump can be improved.

Now, the constitution of a high pressure fuel supply pump according to a third embodiment of the present invention will be described with reference to FIG. 6.

Figure 6:
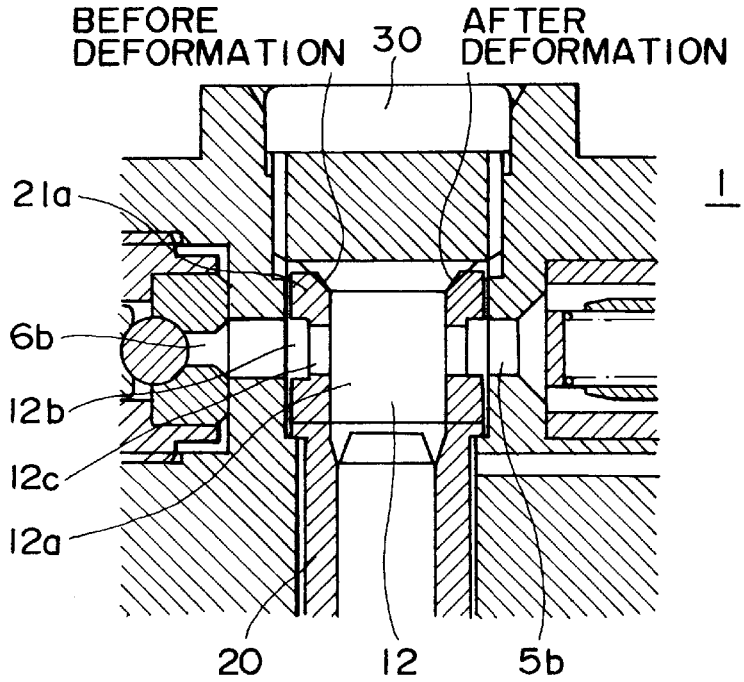
FIG. 6 is a partial enlarged view showing a vertical sectional view of a high pressure fuel supply pump according to a third embodiment of the present invention.

FIG. 6 is a partial enlarged view showing a vertical sectional view of a high pressure fuel supply pump according to the present embodiment. The whole constitution of the high pressure fuel supply pump is similar to that shown in FIG. 4. The same reference numerals as those of FIGS. 1 to 5 indicate the same parts.

Also in the present embodiment, the pressurizing chamber 12 is provided with the main pressurizing chamber 12*a* and the sub-pressurizing chamber 12*b*. The feature of the present embodiment comprises a method of forming the pressurizing chamber 12, which is the other example of those shown in FIGS. 4 and 5.

In the present embodiment, the periphery of the pressurizing chamber comprises a member for forming a pressurizing chamber 21 which is a member different from the cylinder 20. An upper end portion 21*a* of the pressurizing chamber forming member 21 has a function similar to that of the upper end portion 20*a* of the cylinder shown in FIG. 5.

According to the present embodiment, further, it is possible to suppress deformation of a sliding hole of a plunger of the cylinder 20.

In examples shown in FIGS. 4 to 6, the outer circumference of the fixing member 30 is formed with threads which are threadedly engaged, to thereby exert compressive force on the cylinder 20, but not limiting to the threads.

As described above, according to the present embodiment, since low pressure fuel can be supplied to the common rail without impairing piston motion of the high pressure pump when the engine starts or the like, the fuel supply property to the common rail immediately after start of the engine can be improved, and the pressure increasing characteristic of the high pressure fuel supply pump can be improved.

According to the present embodiment, the fuel supply property to the common rail immediately after start of the engine can be improved.

Further, the pressure increasing property to the common rail immediately after start of the engine in the high pressure fuel supply pump can be improved.

In the following, the constitution of a seal mechanism of a high pressure fuel supply pump according to one embodiment of the present invention will be described with reference to FIGS. 7 to 10.

First, the whole constitution of a fuel injection system using a high pressure fuel supply pump according to the present embodiment will be described with reference to FIG. 7.

Fuel in a tank 50 is guided to a fuel intake passage 110 of a pump body 100 by a low pressure pump 51. At that time, the fuel guided to the fuel intake passage 110 is regulated to a fixed low pressure by means of a pressure regulator 52. At this time, fuel pressure is regulated, for example, to 0.3 MPa in relative pressure in association with the atmospheric pressure as a reference. The fuel guided to the pump body 100 is pressurized by the pump body 100, and is fed under pressure from a fuel discharge passage 111 to the common rail 53. Pressure of fuel discharged from the fuel discharge passage 111 is pressurized, for example, to 7 to 10 MPa in relative pressure in association with the atmospheric pressure as a reference.

On the common rail 53 are mounted with an injector 54, a relief valve 55, and a pressure sensor 56. The injector 54 is mounted while adjusting its number with the number of cylinders of the engine, and injects a fixed quantity of fuel at fixed timing in accordance with a signal of an engine control unit (ECU). The relief valve 56 opens when pressure in the common rail 53 exceeds a fixed value to prevent breakage of a piping system.

The schematic constitution of the pump body 100 will be described below. The detailed constitution of the pump body 100 will be described later with reference to FIG. 8.

The pump body 100 is provided with a fuel intake passage 110, a fuel discharge passage 111, and a pressurizing chamber 112. The fuel intake passage 110 and the fuel discharge passage 111 are provided with an intake valve 105 and a discharge valve 106, respectively, which are held in one direction by springs 105*a* and 106*a*, respectively, in the form of a check valve for limiting a flowing direction of fuel.

A plunger 102 is supported to be capable of being reciprocated and slidably moved within a cylinder 108. A pressurizing chamber 112 is formed between an upper portion in the cylinder 108 and an end of the plunger 102.

In the outer peripheral portion of the plunger 102 is provided with a seal material 120 fabricated of an elastic substance to prevent fuel in the pump from flowing out to the outside. The outer peripheral portion of the seal material 120 is secured to the cylinder 108. The inner peripheral portion of the seal material 120 slidably holds the plunger 102.

The plunger 102 is reciprocated whereby the volume in the pressurizing chamber 112 is varied. When the intake valve 105 is closed during the compression stroke of the plunger 102, pressure in the pressurizing chamber 112 rises whereby the discharge valve 106 is automatically opened to feed fuel under pressure to the common rail 53. While the intake valve 105 is automatically opened when pressure of the pressurizing chamber 112 gets lower than that of the fuel introducing port, closing of valve is decided by operation of a solenoid 130 controlled by ECU 60.

The solenoid 130 is mounted on the pump body 100. The solenoid 130 is provided with an engaging member 131 and a spring 132. The engaging member 131 is applied, when the solenoid 130 is turned OFF, with biasing force in a direction of opening the intake valve 105 by means of a spring 132. Since the biasing force of the spring 132 is greater than that of an intake valve spring 105*a*, when the solenoid 130 is turned OFF, the intake valve 105 is in the open state.

Energization to the solenoid is limited so that where high pressure fuel is supplied from the pump body 100, the solenoid 130 is in the On (energization) state, and where a supply of fuel is stopped, the solenoid 130 is in the OFF (deenergization) state. When the solenoid 130 maintains the ON (energization) state, electromagnetic force in excess of biasing force of the spring 132 is generated to draw the engaging member 131 towards the solenoid 132 so that the engaging member 131 is separated from the intake valve 105. In this state, the intake valve 105 is in the form of an automatic valve to be opened and closed in synchronism with reciprocating motion of the plunger 102. Accordingly, during the compression stroke, the intake valve 105 is closed, and fuel for a portion reduced in volume in the pressurizing chamber 112 pushes to open the discharge valve 106 and is fed under pressure to the common rail 53.

On the other hand, when the solenoid 130 maintains OFF (deenergization) state, the engaging member 131 is engaged with the intake valve 105 by the biasing force of the spring 132 to hold the intake valve 105 in the open state. Accordingly, since also in the compressions stroke, pressure of the pressurizing chamber 112 maintains the low pressure state substantially equal to that of the fuel introducing port, the discharge valve 106 cannot be opened, and fuel for a portion reduced in volume of the pressurizing chamber 112 is returned to the fuel introducing port side passing through the intake valve 105.

Further, if in the midst of the compression stroke, the solenoid 130 is turned into an ON state, fuel is fed under pressure to the common rail 53 from that time. Further, if pressure feeding is once started, pressure in the pressurizing chamber 112 rises, and therefore, even if the solenoid 130 is turned into an OFF state, the intake valve 105 maintains its closed state, and is automatically opened in synchronism with the start of the intake stroke.

Further, according to the present embodiment, a space 107 on the fuel chamber side of the seal material 120 is connected to the fuel intake passage 110 through a connecting passage 109 and a check valve 113. The check valve 300 is provided so as to control a flowing direction of fuel from the fuel intake passage 110 side to the fuel chamber side space 107. In the state in which the check valve 112 is opened, low pressure (for example, pressure higher by 0.3 MPa than the atmospheric pressure) supplied to the fuel intake passage 110 is applied to the fuel chamber side space 107 of the seal material 120.

Accordingly, fuel passing through a gap between the cylinder 108 and the plunger 102 from the pressurizing chamber 112 in the pressurizing stroke can flow into the fuel intake passage 110 side which is a low pressure portion, and pressure on the fuel chamber side of the seal material 120 is equal to that of the fuel intake passage 110 to enable prevention of an external leakage of fuel without considerably increasing the rigidity of the seal material 120.

On the other hand, when the seal material 120 is broken or fallen off so that fuel begins to leak outside, pressure of the fuel chamber side space 107 is lower than that of the fuel intake passage 110 side, whereby the check valve 113 is closed to prevent an inflow of fuel from the fuel intake passage 110 side. Therefore, only the fuel passing through the gap between the cylinder 108 and the plunger 102 from the pressurizing chamber 112 flows into the seal material 120 portion. This flow-rate is in inverse proportion to the length of the sliding portion between the cylinder 108 and the plunger 102, and if the distance for which the plunger 102 can slidably move adequately is secured as in the present embodiment, the flow-rate can be suppressed to a small quantity. Accordingly, even when the seal material 120 is broken or fallen off, it is possible to prevent a large quantity of fuel from flowing out in a short period of time.

Further, since as described above, the outflow of fuel from the pressurizing chamber 112 through the gap of the plunger sliding portion is minimized, the discharge efficiency of the pump can be enhanced during the normal operation.

The construction of the high pressure fuel supply pump according to the present embodiment will be described with reference to FIG. 8.

Figure 7:
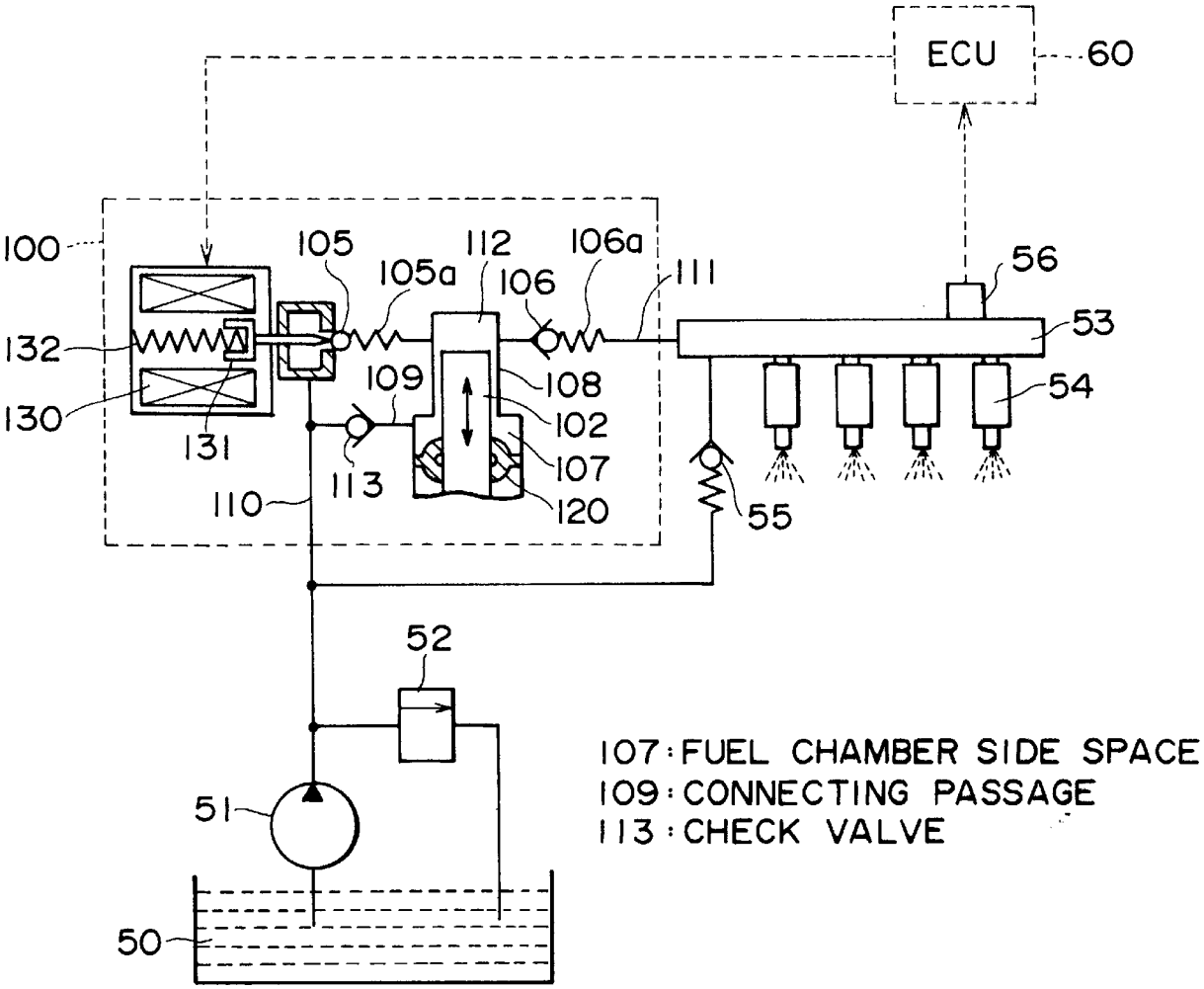
FIG. 7 is an entire system constituent view of a fuel injection system using a high pressure fuel supply pump according to a fourth embodiment of the present invention.
Figure 8:
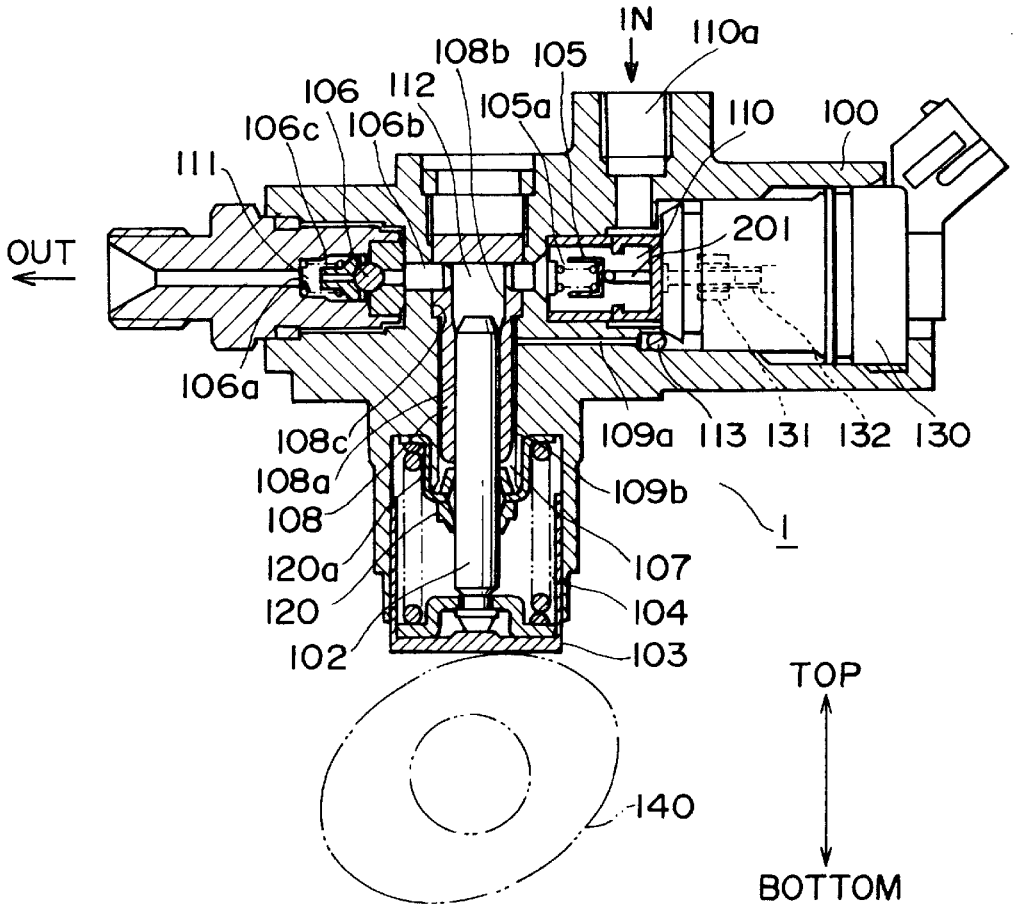
FIG. 8 is a longitudinal sectional view showing the constitution of a high pressure fuel supply pump according to a fourth embodiment of the present invention.

FIG. 8 is a longitudinal sectional view showing the constitution of a high pressure fuel supply pump according to one embodiment of the present invention. The same reference numerals as those of FIG. 7 designate the same parts.

The pump body 100 is provided with a fuel intake passage 110, a fuel discharge passage 111, and a pressurizing chamber 112. The fuel intake passage 110 and the fuel discharge passage 111 are provided with an intake valve 105 and a discharge valve 106, respectively, which are held in one direction by springs 105*a* and 106*a*, respectively, to limit a flowing direction of fuel serving as a check valve.

A plunger 102 as a pressurizing member is slidably held in a pressurizing chamber 112 formed interiorly of a cylinder 108. The pressurizing chamber 112 is formed by the cylinder 108 having a sliding hole 108*a* for supporting the plunger 102 to be capable of being reciprocated and slidably moved. The inside diameter portion of the cylinder 108 comprises a sliding hole 108*a* whose diametral gap relative to the plunger 102 is equal to or smaller than 10 $\mu$m in order to minimize a leakage of fuel from the pressurizing chamber, and a large-diameter inner wall 108*b* formed to have a large diameter in order to form the pressurizing chamber.

The cylinder 108 is held by press-fitting a part of an outer wall 108*c* corresponding to the large diameter inner wall 108*b* into the body 1. Thereby, deformation in dimension of the inside diameter of cylinder caused by the press-fitting occurs only in the large diameter inner wall portion 108*b*, and the sliding hole 108*a* can maintain a dimensional state processed in advance. Accordingly, finish-processing of the sliding hole 108*a* after the press-fitting is unnecessary, and a material having a good abrasion resistance may be selected merely for the sliding portion, thus reducing the cost. Even if materials different in linear expansion coefficient are used for the body 1 and the cylinder 108, deformation in inside diameter of cylinder caused by change in temperature occurs merely in the large diameter inside wall 108*b*, thus not exerting a bad influence on the sliding property of the plunger 2.

An annular passage 109 is provided between the cylinder 108 and the pump body 1, the annular passage 109 being communicated with the sliding hole 108*a*, and the intake passage 110 in communication with a fuel introducing port 110*a* and the annular passage 109 are communicated by a passage 109*b*. Thereby, since pressure in the annular passage 109 is substantially the same pressure (atmospheric pressure+0.3 MPa) as that of the introducing port 100*a*, a pressure difference from the pressurizing chamber 112 is reduced, so that a leakage of fuel from a pressing-in portion 108*c* and the sliding hole 108*a* can be reduced. Heat generation at the sliding portion can be cooled by fuel, and seizure of the sliding portion can be prevented.

A seal material 120 fabricated from an elastic substance is provided on the outer peripheral portion of the plunger 102 in order to prevent fuel in the pump from flowing out and to prevent oil for lubricating a cam 140 from flowing into the pump. In the present embodiment, the seal material 120 is formed integrally with a metal tube 120*a* and is press-fitted in the pump body 100, but a method of fixing the seal material 120 is not limited to the above method. An end of the metal tube 120*a* formed integrally with the seal material 120 is fitted in the pump body 100. A leakage of fuel from the sliding portion between the plunger 102 and the seal material 120 can be reduced by extending length of the seal material 120. Since pressure on the fuel chamber side of the seal material 120 is the pressure of low pressure fuel (which is, for example, higher than the atmospheric pressure by 0.3 MPa), and pressure on the other side of the seal material 120 is the atmospheric pressure, a pressure difference between both end surfaces of the seal material 120 is small, for example, 0.3 MPa, and therefore, sealing property can be enhanced even if the full length of the seal material 120 is not so much prolonged.

A lifter 103 provided on the lower end of the plunger 102 is pressed against a cam 140 by means of a spring 104. The plunger 102 is reciprocated by the cam 140 rotated by an engine cam shaft or the like to change the volume in the pressurizing chamber 112. When the intake valve 105 is closed during the compression stroke of the plunger 102, pressure in the pressurizing chamber 112 rises whereby the discharge valve 106 is automatically opened to feed fuel under pressure to the common rail 53. While the intake valve 105 is automatically opened when pressure of the pressurizing chamber 112 is lower than that of the fuel introducing port, closing of valve is decided by operation of a solenoid 130.

The solenoid 130 is mounted on the pump body 100. The solenoid 130 is provided with an engaging member 131 and a spring 132. The engaging member 131 is applied, when the solenoid 130 is turned OFF, with biasing force in a direction of opening the intake valve 105 by a spring 132. Since the biasing force of the spring 132 is greater than that of an intake valve spring 105*a*, the intake valve 105 is in the open state when the solenoid is turned OFF as shown in the figure.

Energization to the solenoid 130 is limited so that where high pressure fuel is supplied from the pump body 100, the solenoid 130 is turned into the ON (energization) state, and where a supply of fuel is stopped, the solenoid 130 is turned into the OFF state (deenergization).

When the solenoid 130 holds the ON (energization) state, electromagnetic force greater than the biasing force of the spring 132 is generated to draw the engaging member 131 toward the solenoid 132, and therefore, the engaging member 131 is separated from the intake valve 105. In this state, the intake valve 105 takes the form of an automatic valve which is opened and closed in synchronism with reciprocation of the plunger 102. Accordingly, during the compression stroke, the intake valve 105 is closed, and fuel for a portion reduced in volume of the pressurizing chamber 112 pushes to open the discharge valve 106 and is fed under pressure to the common rail 53.

On the other hand, when the solenoid 130 holds the OFF (deenergization) state, the engaging member 131 is engaged with the intake valve 105 by the biasing force of the spring 132 to hold the intake valve 105 in the open state. Accordingly, even in the compression stroke, since pressure of the pressurizing chamber 112 keeps the low pressure state substantially equal to that of the fuel introducing port, the discharge valve 106 cannot be opened, and fuel for a portion reduced in volume of the pressurizing chamber 112 is returned to the fuel introducing port passing through the intake vale 105.

If the solenoid 130 is turned into the ON state in the midst of the compression stroke, fuel is fed under pressure to the common rail 53 from that time on. If feeding under pressure is once started, pressure in the pressurizing chamber 112 rises, and therefore, even if the solenoid 130 is turned into the OFF state later, the intake valve 105 maintains its closed state, and is automatically opened in synchronism with the start of the intake stroke.

Further, the pump body 100 is interiorly provided with a longitudinal passage 109*b* connected to the fuel chamber side space 107 of the seal material 120 and a lateral passage 109*a* connected to the longitudinal passage 109*b* to constitute a connecting passage 109 as shown in FIG. 7. The longitudinal passage 109*b* is easily formed because it is formed between the outer peripheral portion of the cylinder 108 and a hole formed in the pump body 100 by inserting and fitting the cylinder 108 into the hole formed in the pump body 100. A check valve 113 is provided on the end of the lateral passage 109*a*. The check valve 113 is formed from a ball-like elastic substance. Materials for the check valve 113 to be used are those having gasoline resistance, for example, such as fluorine rubber, nitrile rubber, etc. The check valve 113 is normally in the open state, details of which will be described later with reference to FIGS. 9 and 10. As described above, the fuel chamber side space 107 of the seal material 120 is connected to the fuel intake passage 110 through the connecting passage 109 and the check valve 113. The check valve 113 is provided so as to control a flowing direction of fuel from the fuel intake passage 110 to the fuel chamber side space 107. In the state in which the check valve 113 is open, low pressure (for example, pressure higher than the atmospheric pressure by 0.3 MPa) supplied to the fuel intake passage 110 is applied to the fuel chamber side space 107 of the seal material 120.

Thereby, fuel passing through a gap between the cylinder 108 and the plunger 102 from the pressurizing chamber 112 in the pressurizing stroke can flow into the fuel intake passage 110 side which is a low pressure portion, and therefore, pressure on the fuel chamber side of the seal material 120 is equal to that of the fuel intake passage 110 to enable suppression of an external leakage of fuel without considerably increasing rigidity of the seal material 120.

On the other hand, when the seal material 120 is broken or fallen off so that fuel begins to leak outside, the pressure of the fuel chamber side space 107 is lower than that of the fuel intake passage 110, and therefore, the check valve 300 is closed to enable prevention of fuel from flowing into from the fuel intake passage 110 side. Therefore, only the fuel passing through a gap between the cylinder 108 and he plunger 102 from the pressurizing chamber 112 flows into the seal material 120 portion. This flow-rate takes in inverse proportion to the length of the sliding portion between the cylinder 108 and the plunger 102, and therefore, if distance in which the plunger 102 can be slidably moved adequately is secured as in the present embodiment, the flow-rate can be suppressed to a small quantity. Accordingly, even when the seal material 120 is broken or fallen off, it is possible to prevent a large quantity of fuel from flowing out in a short period of time.

Further, as described above, since the outflow of fuel in the pressurizing chamber 112 from the gap of the plunger sliding portion is suppressed to the minimum, the discharge efficiency of the pump can be enhanced during normal operation.

The construction of a check valve used for a high pressure fuel supply pump according to the present embodiment will be described hereinafter with reference to FIGS. 9 and 10.

Figure 9:
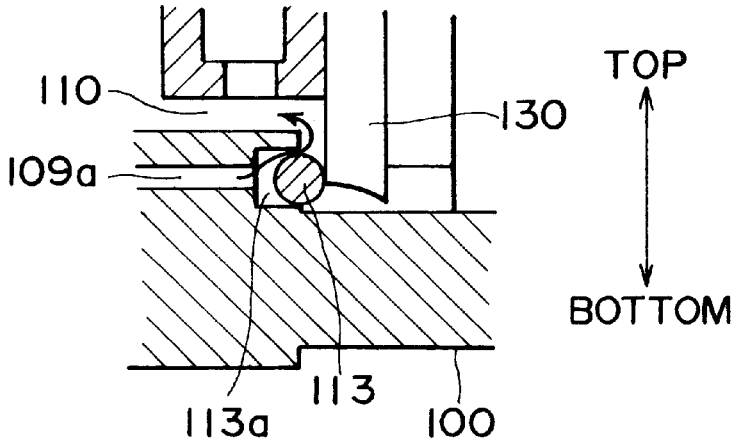
FIG. 9 is a sectional view when a check valve is opened, using a high pressure fuel supply pump according to a fourth embodiment of the present invention.
Figure 10:
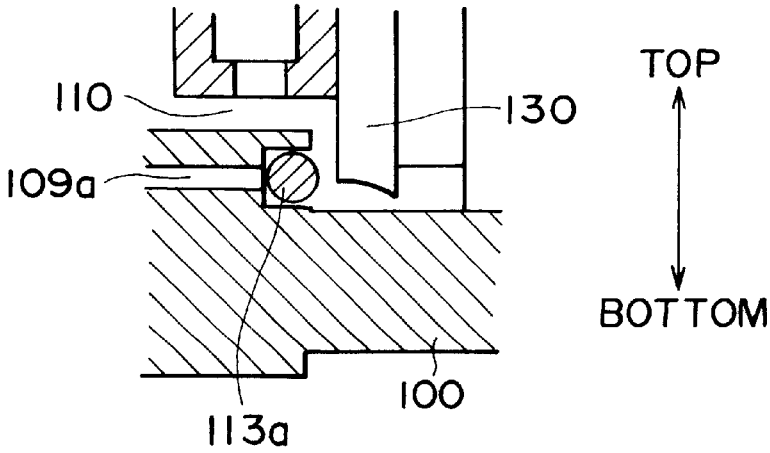
FIG. 10 is a sectional view when a check valve is closed using a high pressure fuel supply pump according to a fourth embodiment of the present invention.

FIG. 9 is a sectional view when a check valve is opened using a high pressure fuel supply pump according to one embodiment of the present invention, and FIG. 10 is a sectional view when a check valve is closed using a high pressure fuel supply pump according to one embodiment of the present invention.

As shown in FIG. 9, a check valve 113 formed from a ball-like elastic substance is controlled in movement in a right direction in the figure by an end of a solenoid 130 in order to prevent it from falling off from a lateral passage 109*a*. A seat surface 113*a* with which the check valve 113 is engaged to close the valve is formed on the right side end in the figure of the lateral passage 109*a*, but is formed perpendicular to the lateral passage 109*a* extending in a horizontal direction, because of which, it forms a substantially vertical surface. In a pump body 100, the vertical direction as shown in the figure is the top and bottom direction. Accordingly, in the state in which the pump body 100 is mounted in the top and bottom direction, the ball-like check valve 113 is not in contact with the seat surface 113*a*, so that when the front and rear pressures of the check valve 113 is equal to each other, it can be turend into the open valve state.

A countermeasure to prevent falling-off of the check valve 113 is not limited to the means using the end of the solenoid 130, but for example, a separate member may be used to prevent the check valve 113 from falling off. Alternatively, the lateral passage 109*a* may be inclined so that the seat surface 113*a* is in the lower direction. Further alternatively, also the seat surface 113*a* is not only to be made substantially vertical but may be inclined. Further, the check valve 113 may be installed not only at the outlet of the lateral passage 109*a* but within the passage. Further, when the seat surface 113*a* forms the horizontal surface, a spring or the like may be interposed between the check valve 113 and the seat surface 113*a* so that when the front and rear pressures of the check valve 113 are equal to each other, the check valve 113 is not closed.

As described above, also when the pump is stopped, the check valve 113 is opened to thereby prevent the check valve 113 from being adhered to the seat surface 113*a*. Further, since also during operation, the opening valve pressure of the check valve 113 is zero, pressure in the fuel chamber side of the seal material 120 can be made equal to that of the fuel intake passage 110 portion.

On the other hand, as shown in FIG. 10, when pressure on the fuel chamber side of the seal material 120 is lowered due to the falling off of the seal material 120, pressure of the lateral passage 109*a* gets lower than the pressure of the fuel intake passage 110. Therefore, the check valve 113 is pressed against the seat surface 113*a* so that the check valve 113 is promptly closed to prevent fuel from flowing out from the fuel intake passage 110 side.

Further, the check valve 113 is formed from an elastic substance whereby hardness of the seat surface 113*a* need not be increased, and it can be fabricated inexpensively.

As described above, in the present embodiment, the fuel chamber side space 107 of the seal material 120 is connected to the fuel intake passage 110 to constitute a fuel reservoir to which low pressure (for example, pressure higher by 0.3 MPa than the atmospheric pressure) supplied to the fuel intake passage 110 is applied. That is, the fuel reservoir is not provided within the sliding portion of the plunger, as in the prior art. That is, the pressurizing chamber 112 being high pressure is formed at the upper end in the figure of the cylinder 108, whereas the fuel chamber side space 107 (fuel reservoir) being low pressure is formed at the lower end in the figure of the cylinder 108, and therefore, the distance from the pressurizing chamber 112 to the fuel chamber side space (fuel reservoir) 107 can be prolonged so that a leakage of the high pressure fuel of the pressurizing chamber 112 to the fuel chamber side space 107 can be easily reduced. Accordingly, the pump can be miniaturized, and the leakage during pressurizing can be reduced to enhance the discharge efficiency.

Further, in the present embodiment, since the passage having substantially atmospheric pressure as in the prior art is not provided on the fuel chamber side of the seal material, processing of such a passage is unnecessary, and piping for connecting from the pump to the fuel tank is also unnecessary. Accordingly, the manufacturing cost is low.

Further, the seal material 120 has the construction in which the integrally molded metal pipe 120*a* is secured to the pump body 100, so that the length of the seal material 120 tends to be prolonged to extend the sliding distance relative to the plunger 102, thus enabling enhancement of the sealing property, and since pressure applied to both ends of the seal material 120 is low pressure, the sealing property can be enhanced.

Further, when the seal material 120 is broken or the like, the check valve 113 provided on the connecting passage 109 for communicating the fuel intake passage 110 with the fuel chamber side space 107 is activated to promptly prevent fuel from leaking from the fuel intake passage 110 to the atmosphere side.

Further, since during operation of the pump, the check valve 113 is in the open state, it is possible to easily prevent the check valve from adhering to the seat surface.

According to the present embodiment, even when the seal material of the sliding portion is broken or fallen off, an external leakage of fuel can be suppressed to a small quantity, as well as being small in size and inexpensive.

Figure 11:
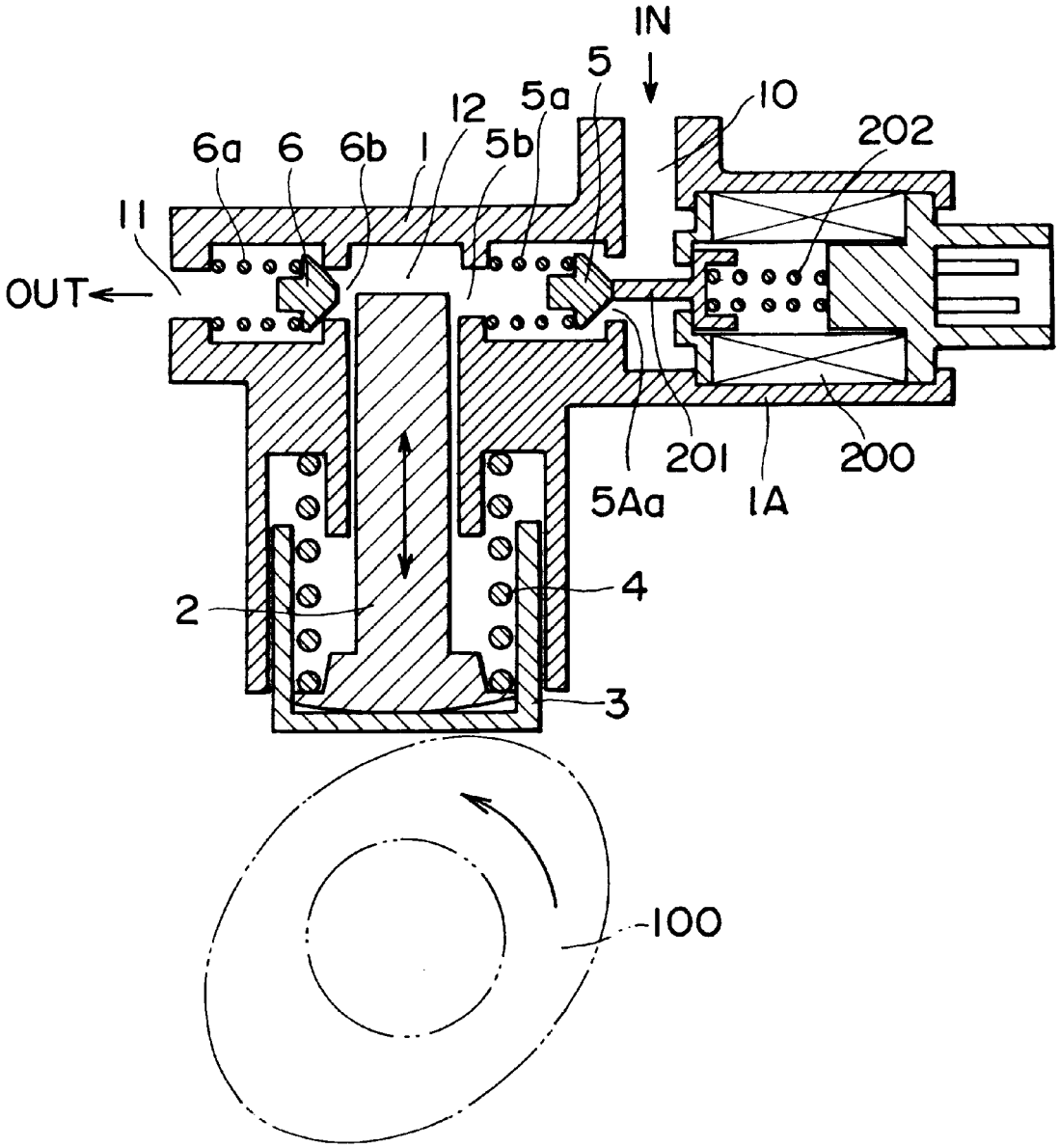
FIG. 11 is a view for explaining a conception of a variable capacity mechanism according to the present invention, by conceptually showing FIGS. 2 and 8.

While some embodiments have been described, the characteristic constitution common to these embodiments will be further explained in detail hereinafter with reference to FIG. 11.

A pump body 1 is formed with a fuel intake passage 10, a discharge passage 11, and a pressurizing chamber 12. A plunger 2 as a pressurizing member is slidably held on the pressurizing chamber 12. The intake passage 10 and the discharge passage 11 are formed with an intake chamber 5A and a discharge chamber 6A, respectively, leading to an intake hole 5*b* and a discharge hole 6*b*, respectively, of the pressurizing chamber 12, the respective chambers being provided with an intake valve 5 and a discharge valve 6. The intake valve 5 and the discharge valve 6 are held in one direction by springs 5*a* and 5*a*, respectively, to constitute a check valve for restricting a flowing direction of fuel. More specifically, the intake valve 5 is biased by spring 5*a* so as to close a hole 5Aa from the inside of the inlet hole 5Aa of the intake chamber 5A. A solenoid 200 as an electromagnetic driving device is pressed and held in a tubular casing portion 1A formed integrally with the pump body 1, the solenoid 200 being provided with an engaging member 201 formed as a plunger rod, and a spring 202. When the solenoid 200 is turned OFF, the engaging member 201 is guided to a projecting position by the spring 202, as a consequence of which, it is engaged with the intake valve 5 to bias it in a direction of opening the valve. Since biasing force of the spring 202 is set to be greater than that of the spring 5*a* for biasing the intake valve 5 in a closing direction, when the solenoid 200 is turned OFF, the intake valve 5 is pushed to open by the engaging member 201 to assume the open state. Fuel is guided by the low pressure pump 51 from the tank 50 to the fuel introducing port of the pump body 1, and is regulated to a fixed pressure by the pressure regulator 52. Thereafter, fuel is pressurized by the pump body 1 and fed under pressure from the fuel discharge port 11 to the common rail 53 in FIG. 7.

The operation of the high pressure pump constituted as described above will be described hereinafter.

The lifter 3 provided at the lower end of the plunger 2 is pressed against the cam 100 by the spring 4. The plunger 2 is reciprocated by the cam 100 rotated by an engine cam shaft or the like to change the volume in the pressurizing chamber 12.

When the intake valve 5 is closed during the compression stroke of the plunger 2, pressure in the pressurizing chamber 12 rises whereby the discharge valve 6 is automatically opened to feed fuel under pressure to the common rail 53.

The intake valve 5 is automatically opened when pressure of the pressurizing chamber 12 gets lower than that of the fuel introducing port, but closing of valve is decided according to operation of the engaging member 201 of the solenoid 200.

When the solenoid 200 keeps the ON (energization) state, electromagnetic force in excess of biasing force of the spring 202 is generated, the engaging member 201 is drawn to the solenoid 202 side to assume a returning position, at which point of time the engaging member 201 is separated from the intake valve 5. In this state, the intake valve 5 works as an automatic valve which is opened and closed by a pressure difference between upstream and downstream of the intake valve 5 in synchronism with the reciprocation of the plunger 2. Accordingly, during the compression stroke, the intake valve 5 is closed, and fuel for a portion reduced in volume of the pressurizing chamber 12 pushes to open the discharge valve 6 and is fed under pressure to the common rail 53. Thereby, the maximum discharge of the pump can be carried out irrespective of the respondence of the solenoid 200.

On the other hand, when the solenoid 200 is in the OFF (deenergization) state, the engaging member 201 is engaged with the intake valve 5 by biasing force of the spring 202 to hold the intake valve 5 in the open state. Accordingly, fuel in the cylinder (in the pressurizing chamber) is returned through the through hole 5Aa opened during the compression stroke so that pressure of the pressurizing chamber 12 keeps the low pressure state substantially equal to the fuel introducing port, because of which, the discharge valve 6 cannot be opened. Thereby, the pump discharge quantity can be made zero.

If the solenoid 200 is turned into the ON state in the midst of the compression stroke, the intake valve 5 which has lost biasing force in the opening direction caused by the engaging member 201 to momentarily close the through hole 5Aa by the spring 5*a* and the pressure of the pressurizing fuel. Accordingly, the discharge valve 6 is opened, from that time on, to feed fuel under pressure from the discharge hole 11 to the common rail 53. If pressure feeding is once started, pressure in the pressurizing chamber 12 rises till next intake stroke takes place, and therefore, even if the solenoid 200 is turned into the OFF state later, the intake valve 5 maintains its closed state till next intake stroke starts. When the intake stroke starts, pressure in the pressurizing chamber gets lower than that of the low pressure passage so that the intake valve 5 is automatically opened. Thereby, the discharge quantity can be adjusted according to ON timing of the solenoid 200 (that is, drawing timing of the engaging member). Since the engaging member of the solenoid 200 may be returned to the projecting position (that is, the position when the solenoid is turned OFF) before the compression stroke starts, the high speed respondence of the engaging member 201 is not required. Thereby, biasing force of the spring 202 can be made small, and as a consequence, the OFF-ON respondence of the solenoid 200 (that is, the projection-drawing respondence of the engaging member) can be improved.

Importantly, being different from the conventional electromagnetic driving valve, since the solenoid will suffice to draw the plunger rod only, the movable portion becomes light, from which point, the respondence is improved. Driving can be made by a small solenoid.

Further, since the valve body is not strongly knocked against the seat by electromagnetic attraction different from the electromagnetic valve, no damage possibly occurs.

The ON time or ON timing of the solenoid 200 in the compression stroke is controlled whereby the discharge quantity to the common rail 53 can be controlled variably. Further, adequate discharge timing is computed by the ECU on the basis of a signal of a pressure sensor 56 to control the solenoid 200, whereby pressure of the common rail 53 can be maintained at substantially constant value. Further, the OFF-ON respondence can be enhanced without making the solenoid 200 larger in size.

Next, modifications of the intake valve 5, the engaging member 201, and the valve body will be described with reference to FIGS. 12 to 14. In these embodiments, either of the intake valve 5 and the engaging member 201 is made to be a concave shape, while the other is made to be a convex shape so that the concavo-convex engagement is provided. With this constitution, it is possible to prevent the engaging portion from being displaced and/or slipped off, and the secure operation of the intake valve 5 and the engaging member 201 can be carried out. While in the present embodiment, the shape of the intake valve 5 is in the form of a ball valve and a cylindrical valve, it is noted that a conical valve, a reed valve or the like can be also employed.

Figure 12:
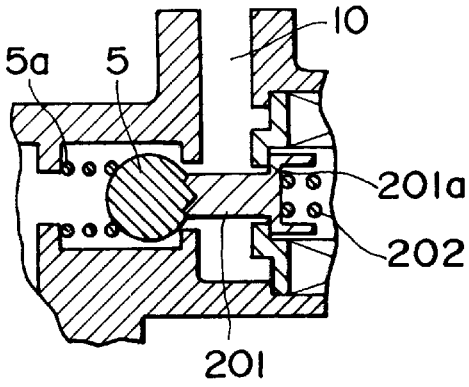
FIGS. 12 to 14 are respectively views showing other embodiments of a spill valve (an overflow valve) or an intake valve of another embodiment.
Figure 13:
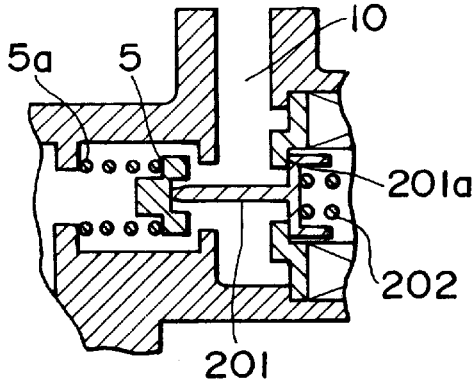

In FIGS. 12 and 13, a position of the intake valve 5 upon opening is decided by a stopper 201*a* portion provided on the engaging member 201. With this, since set load of the spring 202 can be maintained constant, attraction speed (valve-closing respondence) of the engaging member 201 can be stabilized. Accordingly, control of the valve-closing timing is made easy.

Figure 14:
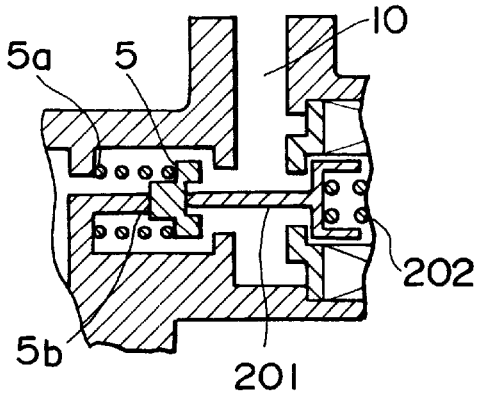

Further, in FIG. 14, a position of the intake valve 5 upon opening is decided by a stopper 5*b* portion provided on the intake valve 5. With this constitution, since a positional relationship between the intake valve 5 and the seat portion can be made constant, passage resistance when the valve is opened can be made constant as well. Accordingly, the opening stroke of the intake valve 5 need not be made greater than that is needed to provide miniaturization.

The position of the stopper can be selected according to the required content of the pump.

Returning to FIG. 8, a further detailed embodiment will be described. In the present embodiment, a ball valve is used for the discharge valve 106, and a cylindrical member 106*c* held for reciprocation and sliding movement in a discharge passage 111 is placed in engagement therewith by means of a spring 106*a*. By doing so, the respective members can be easily fabricated, and the ball valve 106 can be securely held, and oscillations or the like of the ball valve caused by the fuel flow when the valve is opened can be suppressed. Further, it is also possible for holding the ball valve more securely to integrate the cylindrical member 106*c* with the ball valve 106 by welding or the like. These constructions can be also used in the intake valve.

The capacity variable mechanism will be described in further detail with reference to FIGS. 15 and 16. An annular recess portion 5B is formed at a part upstream of an intake hole 5*b* of the pump body 1.

Figure 17:
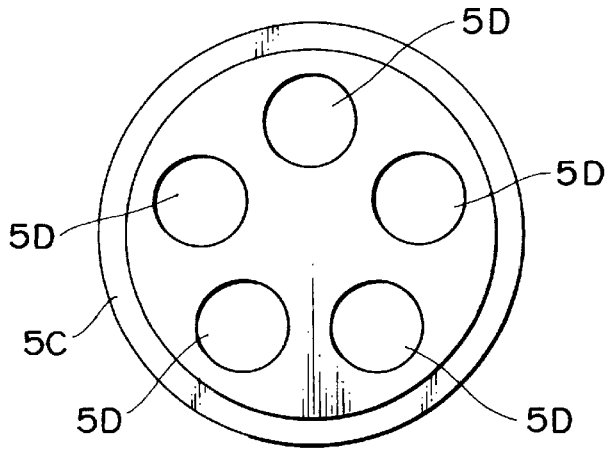
FIG. 17 is a side view of a holder.
Figure 18:
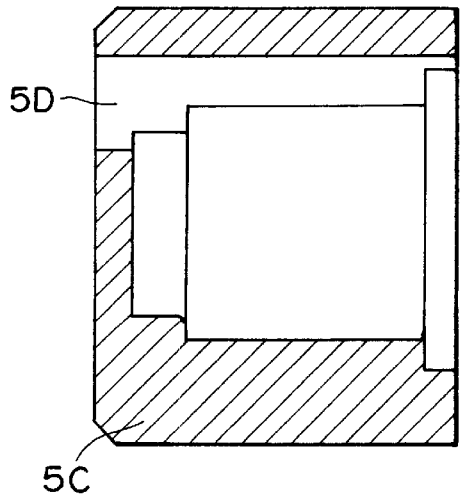
FIG. 18 is a cross sectional view of a holder.

An outer peripheral portion of one end of a holder 5C for accommodating an intake valve 5 is spigot-fitted in the annular recess 5B, both of which are fixedly pressed in. On the intake hole 5*b* side of the holder 5C are bored with five through-holes 5D as shown in FIGS. 17 and 18.

Figure 19A:
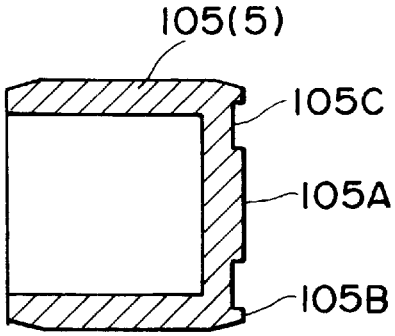
FIG. 19A is a sectional view of an intake valve, 19B being a right side view thereof.
Figure 19B:
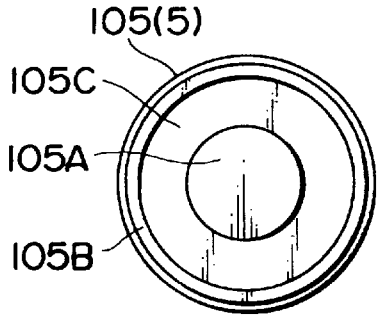

A spring 105*a* (5*a*) is retained in the center of the holder 5. On the intake hole (5*b*) side of the spring 105*d* (5*a*), a cup-shaped valve 105 (5) shown in FIGS. 19A and 19B is mounted so as to surround the spring 105*a* (5*a*).

The pump body 1 is further formed with an annular chamber 110A larger in diameter than that of the annular recess 5B. As a consequence, the chamber 110A forms an intake chamber in communication with a low pressure fuel passage 110.

The pump body 1 is further formed with an annular cavity 130B with a threaded groove 130A larger in diameter than that of the annular chamber 110A.

A solenoid 200 (130) constituting an electromagnetic driving mechanism is mounted on the annular cavity 130A.

An adaptor 200A formed with threads 200*a* is mounted on the outer periphery of the solenoid 200 (130), and the threads are engaged into the threaded groove of the cavity 130A whereby the solenoid is mounted on the cavity 130A.

Numeral 200*b* designates a seal ring, which isolates the fuel intake chamber 110A from outside air.

An annular electromagnetic coil 200B is accommodated in a closed-end cup-shaped outer core 200D. A hollow tubular internal fixed core 200C is inserted into the center of the annular electromagnetic coil 200B. A disk-like radial-direction core portion 200E is formed integrally with one side end of the hollow tubular internal fixed core 200C, and the outer circumference of the diametral-direction core is secured to the inner peripheral wall on the open end side of the cup-like outer core 200D by tension-connection. The electromagnetic coil 200B comprises an annular bobbin 200*c* through which the internal fixed core 200C, a coil 200*d* wound therearound, and a molded resin outer layer 200*f* in which the outer periphery of the coil 200*d* is subjected to molding with resin.

The annular electromagnetic coil 200B is accommodated in a state of being axially pressed between the inner bottom of the cup-shaped outer core 200D and the disk-like radial-direction core portion 200E. A seal ring 200*g* is put in a cavity facing to the bobbin 200*c*, the resin outer layer 200*f* and the inner fixed core 200C. A seal ring 200*h* is put in a cavity facing to the resin outer layer 200*f*, the radial-direction core portion 200E and the cup-shaped outer core 200D.

The open end side of the cup-shaped outer core 200D is sealed by resin mold so as to cover the outside of the radial-direction core portion 200E, and at that time, an outer removing terminal of the electromagnetic coil 200B is also molded together to form a connector 200F.

The P portion circled in FIG. 15 will be described in more detail in an enlarged scale in FIG. 16.

A portion 230 of the bottom of the closed-end cup-shaped outer core 200D has a through hole 231 in the center thereof.

An annular recess 232 is formed continuously to the outside of the through hole 231. The diameter of the annular recess 232 is larger than that of the through hole 231.

A movable core 131*a* is inserted into the through hole 231. An engaging member 201 in the form of a plunger rod is formed integrally with the movable core 131*a*.

An annular movable stopper 201*c* is also formed integrally at a longitudinal intermediate position of the engaging member 201. A C ring-like fixed stopper member 233 is fitted, between the stopper 201*c* and the movable core 131*a*, into the rod portion of the engaging member 201 in the radial direction using a cut groove. In this state, the movable core 131*a* is inserted into the through hole 231, the fixed stopper member 233 is pressedly fixed into the annular recess 232, and the movable core 131*a* and the engaging member 201 are mounted on the solenoid 200 in such a manner of extending through the bottom portion 230 of the outer fixed core 200D.

Further, a guide member 220 is press-fitted in the annular recess 232 so as to hold a C-ring fixed stopper 233.

The guide member 220 is formed with a stopper surface 221 facing to the stopper surface 233*a* of the fixed stopper 233, and a movable stopper 201C can be reciprocated by stroke Ss=45 micron between these two stopper surfaces.

The guide 220 is bored in the center with a guide hole 220*b*. The engaging member 201 extends through the guide hole 220*b* to thereby control the radial movement for reciprocation along the center axis of the solenoid 200.

The guide 220 is bored with a plurality of through holes 220C in a radial direction. The through holes 220C are communicated with a low pressure fuel passage around the guide 220.

The through holes 220C are connected to a center hole 220A of the guide 220. The center hole 220A is open (220B) to the axial end of the guide 220, and an end surface 220*a* around the opening 220B forms a seat surface of the intake valve 105 (5).

Figure 15:
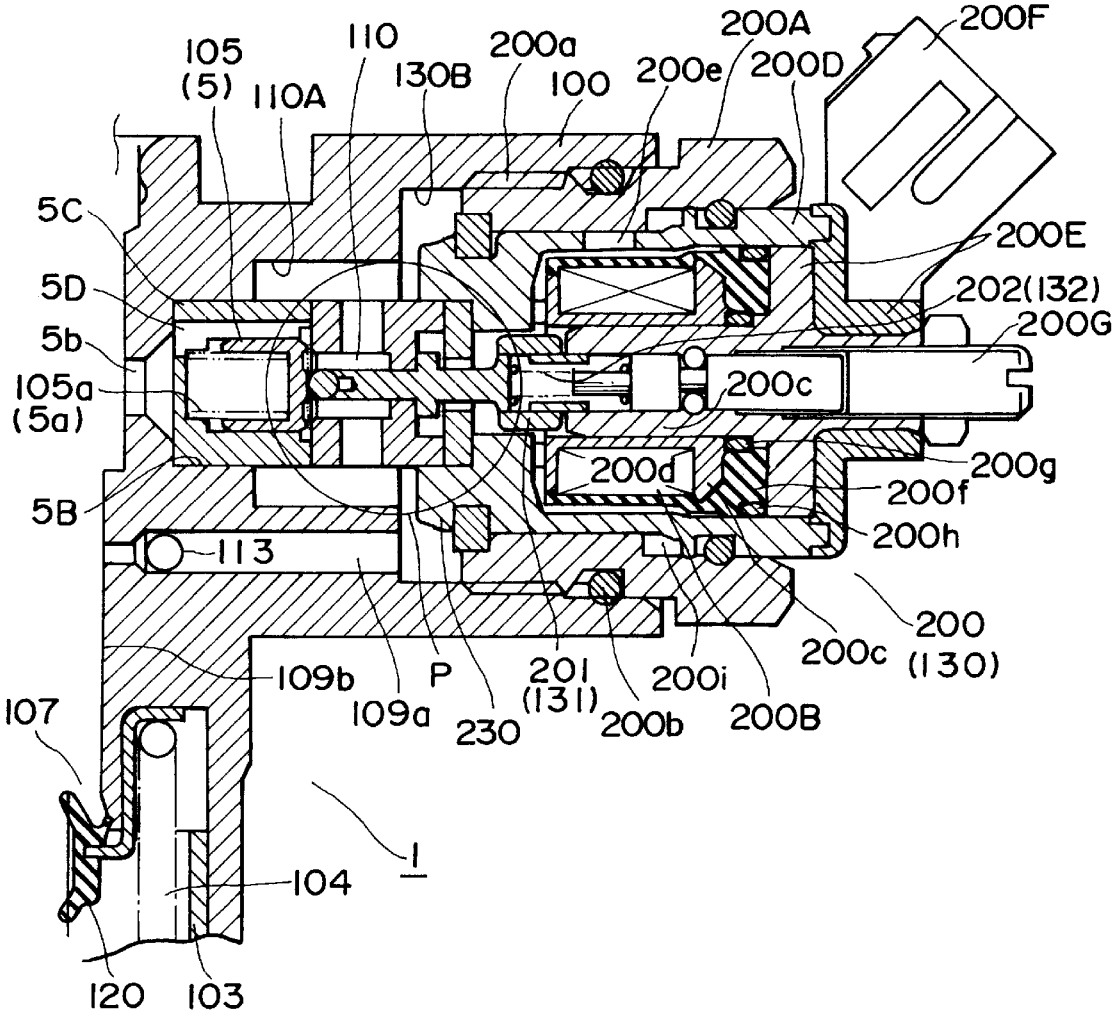
FIG. 15 is a concrete enlarged sectional view of the intake vale of FIGS. 2 and 8, and a portion corresponding to a solenoid driving portion.
Figure 16:
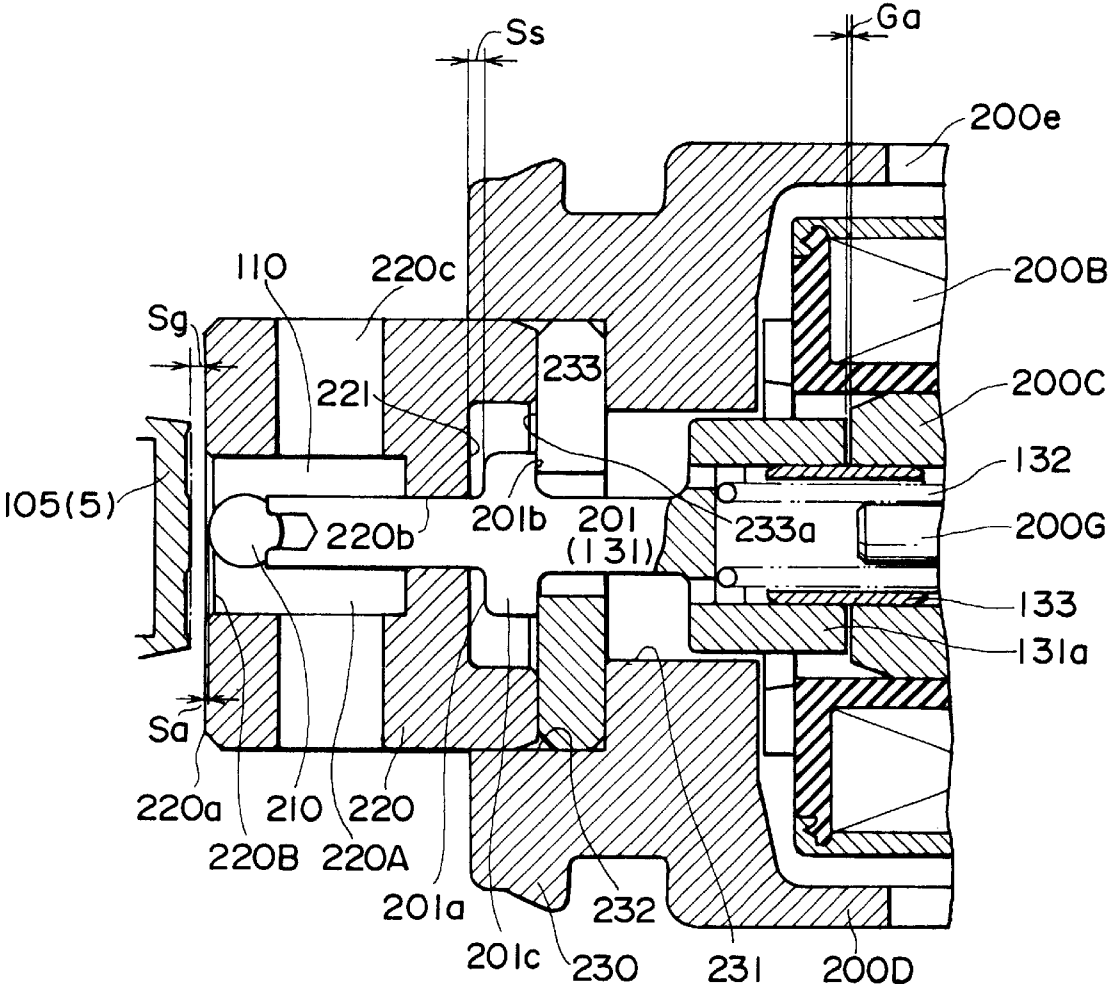
FIG. 16 is an enlarged sectional view of a P portion of FIG. 15.

As a consequence, as shown in FIG. 15, in the state in which the solenoid 200 (130) is mounted on the pump body 1, the outer periphery of the axial-direction end surface of the guide 220 comes in pressure contact with the end surface of the holder 5C, both of which constitute an intake valve mechanism.

In addition, in the engaging member 201, a metal ball is secured to the end of the plunger rod portion by welding.

The cup-shaped movable core 131*a* accommodates internally a spring 202 (132), and one side end of the spring 202 (132) is in contact with the end surface of an adjust screw 200G threadedly fitted in the center of a fixed core 200C in the center side.

The adjust screw 200G adjusts a set load of the spring 202 (132) to adjust properties of moving operation of the engaging member 201.

The spring 202 (132) biases the movable core 131*a* and the engaging member 201 (131) in the direction opposite to the adjuster 200G, and as a result, the stopper surface 201*a* of the stopper 201*c* comes in contact with the stopper surface 221 of the guide member 220.

As a result, the ball member 210 at the end of the engaging member 201 (131) projects by dimension of Sg=35 micron from the end 220*a* of the guide 220. At that time, the ball member 210 causes the valve body 105 (5) to levitate by dimension of Sg=35 micron from the seat surface of the guide member 220 against the force of the spring 105*a* (5*a*) to connect the opening 220B to the intake hole 5*b* of the cylinder through five holes 5D of the holder 5C.

The axial end surface of the movable core 131*a* faces away by a gap Ga from the axial-direction end surface of the inner fixed core 200C. On the other hand, the outer peripheral surface of the movable core 131*a* faces through a slight diametral gap to the inner peripheral surface of the through hole 231 of the outer fixed core 200D.

As a result, when power is supplied (that is, energization) from a connector 200F to a coil 200B, there is formed a closed magnetic path passing through the outer fixed core 200D, the movable core 131*a*, the inner fixed core 200C and the disk member 200E.

As a result, magnetic attraction is generated between the opposing end of the movable core 131*a* and the inner fixed core 200C.

This magnetic attraction draws the movable core 131*a* toward the inner fixed core 200C against the force of the spring 132.

The stroke of the movable core 131*a* terminates at a position where the stopper 201*c* of the engaging member 201 comes in contact with the stopper surface 233*a* of the fixed stopper 233. Its distance is Ss=45 micron.

At the end of stroke of the movable core 131*a*, a gap Ga between the movable core 131*a* and the end surface of the inner fixed core 200C is 6 micron.

A non-magnetic ring 133 is secured to the inner periphery of the movable core 131*a*, a portion projecting from the movable core 131*a* of the non-magnetic ring 133 is guide to the inner peripheral surface of the inner fixed core 200. As a result, the radial movement of the movable core 131*a* is controlled.

Thus, the engaging member 201 and the movable core 131 are guided at two places distanced each other in the axial direction to enable the stable movement.

After all, as a result of the stroke of the movable core 131*a*, the ball member 210 at the end of the engaging member 201 (131) is held at a position withdrawn by dimension of Sa=10 micron from the seat surface 220*a* of the guide member 220.

At that time, the intake valve 105 (5) is disengaged from the ball member 210 and is pressed against the seat surface 220*a* of the guide member 220 by the force of the spring 105*a* (5*a*). As a result, the intake valve 105 (5) closes the center opening 220B of the guide member 220 to intercept between the low pressure fuel passage and the holder 5.

The intake valve 105 (5) is formed in a cup-shape, as shown in FIGS. 19A and 19B, and is held in the state of being put around the spring 105*a* (5*a*).

The axial-direction end surface to be the seal surface has a circular convex portion 105A whose center comes in contact with the ball member 210, and an annular convex portion 105B in contact with the seat surface 220*a* of the guide 220. An annular groove 105 is formed between both the convex portions.

Both the convex portions are subjected to cutting so that their heights are the same.

Since the seat surface is constituted by the annular convex portion 105B, one-sided abutment with the seat surface on the guide member side is reduced so that the contact therebetween becomes tight to enhance the seat property. The intake valve 105 (5), the guide member 220 and the ball member 210 impinge upon one another, the number of times of which extends to a million during the service life of the internal combustion engine. Allowable abrasion of these members under these conditions is only in order of 10 micron. Particularly, when the contact portion between the intake valve 105 (5) and the ball member 210 becomes worn by 35 micron, even if the movable core 131*a* and the engaging member 201 (131) stroke by 45 micron, the intake valve 105 (5) cannot be levitated from the seal surface. That is, in such a state as described, the opening valve state of the intake valve 105 (5) cannot be maintained, and control of capacity cannot be accomplished. Then, it has been found as a result of various studies of conditions less in abrasion that use of material having hardness equal to or more than 30 $H_{RC}$ in Vickers hardness scale is preferable. More specifically, it has been found that as a material to satisfy with this condition, stainless steel SUS440C as set forth in Japanese Industrial Standard (JIS) is advantageous.

On the other hand, since the movable core 131*a* and the plunger rod portion of the engaging member 201 (131) constitute a magnetic path, material need be a magnetic material, from a viewpoint of which it has been found that the magnetic stainless steel SUS420J2 as set forth in Japanese Industrial Standard (JIS) is advantageous.

Thus, in the deenergization state of the coil of the solenoid 200 (130), it can be set so that the force of the spring 132 overcomes the force of the spring 105*a* (5*a*), and the engaging member 201 (131) strokes by 35 micron to levitate the intake valve 105 (5) from the seat surface.

In the present embodiment, since the ball member 210 is separated from the plunger rod portion, materials matching with the respective functions can be used.

Where the movable core 131*a* and the plunger rod portion of the engaging member 201 (131) are formed separately of different materials, and then are integrated by post-processing through a method such as welding or tension bonding, it is possible that the plunger rod portion and the ball member can be formed integrally. In this case, the ball portion, the plunger rod portion and the stopper portion are cut out from the same member by cutting.

The ball member not always need be spherical. The joining surface with the engaging member 201 (131) may be flat. Therefore, the ball member may be a hemisphere.

In the present embodiment, the engaging member is formed at its end with an annular recess, into which a part of a spherical member is embedded and held, and the contact surfaces thereof are welded for joining, and therefore, the joining work is very easy, and the centers of the ball member and the engaging member tend to be registered.

In the present embodiment, mounting of an intake valve mechanism having a variable capacity function is completed merely by press-fitting the valve holder 5C into the recess 5B of the pump body 1, and screwing the solenoid 200 (130) assembled separately into the recess portion 130B with a threaded groove, thus achieving the good workability.

Reference numeral 200*e* designates a foam escaping hole. Where vapor is generated in the low pressure fuel passage due to heat of the engine, the foam is temporarily protected in an annular cavity 200*i* passing through the foam escaping hole 200*e* to prevent the vapor entering the pressurizing chamber in the cylinder 8 passing through the intake valve 105 (5).

In the description of the present embodiment, the entirety including the movable core, the plunger rod portion and the ball member is called, macrowise, the engaging member. However, the movable core may also be formed from a separate member, and it may sometimes be necessary to be distinguished from the movable core in functionality. In some passages, the plunger rod portion and the ball member portion have been explained as the engaging member taking the above into consideration.

In the present embodiment, the valve body is completely separated from the electromagnetic driving mechanism, from which point, the present embodiment is exactly different in constitution and operation from the variable capacity mechanism by way of an electromagnetic valve (a valve being secured to the driving mechanism) in the prior art.

Since extra attraction of the driving mechanism after the contact of the valve body with the seat is completed does not exert on the valve body, the valve body and the seat surface are less worn, and no mechanical stress acts between the valve body and the plunger of the driving mechanism. The force involved in opening operation of the valve body when the valve body is opened due to a pressure difference between upstream and downstream of the valve body is only the spring force for generating a valve closing force, making the movement quick.

In the prior art of the electromagnetic valve system, not only the valve body but also the plunger of the driving mechanism and the movable core need to move together, and it is necessary to make great by what is required for the force of the spring (which exerts in a valve opening direction) on the side of the electromagnetic driving mechanism, and as a result, when driving to the closing side, a great force is necessary whereby the electromagnetic mechanism becomes large.

Further, the movement of the valve body itself also becomes dull.

For the reasons mentioned above, in the present embodiment, despite the fact that the valve body and the electromagnetic plunger are independent thereof, the present embodiment should be clearly distinguished from the prior art electromagnetic valve system.

According to the further characteristic constitution, the intake opening (220*a*) opened and closed by the intake valve 105 (5) is formed on the side of the electromagnetic driving mechanism.

This is the very important constitution in controlling the stroke of the plunger rod as the engaging member 201 (131) on the basis of the seat surface on which the intake valve seats.

That is, this provides the merit capable of independently adjusting and inspecting the seat surface and the stroke of the engaging member before incorporating them into the pump body.

In the present embodiment, the relation between the seat surface of the intake valve and the stroke of the engaging member exactly remains unchanged even after the electromagnetic driving mechanism has been incorporated into the pump body.

What is claimed is:

1. A high pressure fuel supply pump having a pressurizing chamber for pressurizing fuel supplied from an intake passage of fuel by a pressuring member to feed it under pressure to a discharge passage characterized in that:

in addition to a main pressurizing chamber in which said pressurizing member is arranged, a sub-pressurizing chamber for communicating said intake passage with said discharge passage is provided; and said intake passage and said discharge passage are communicated with an upper end portion of said pressurizing chamber.

2. A high pressure fuel supply pump having a pressurizing chamber for pressurizing fuel supplied from an intake passage of fuel by a pressuring member to feed it under pressure to a discharge passage characterized in that:

in addition to a main pressurizing chamber in which said pressurizing member is arranged, a sub-pressurizing chamber for communicating said intake passage with said discharge passage is provided wherein said sub-pressurizing chamber is arranged substantially annularly on the outer circumference of said main pressurizing chamber.

3. A high pressure fuel supply pump having a pressurizing chamber for pressurizing fuel supplied from an intake passage of fuel by a pressuring member to feed it under pressure to a discharge passage characterized in that it comprises:

a pressurizing chamber forming member having a tapered surface at an end and formed from a member separately from a pump body, and said tapered surface of said pressurizing chamber forming member is compression-fitted by a fixing member to thereby form said pressurizing chamber.

4. A high pressure fuel supply having a pressurizing chamber communicated with an intake passage of fuel and a discharge passage, and a pressurizing member for feeding under pressure fuel within the pressurizing chamber to said discharge passage, characterized in that it comprises:

a seal material arranged in a sliding portion of said pressurizing member;

a connecting passage for communicating a fuel passage side of the seal material with a fuel intake passage; and a check valve arranged in the connecting passage to prevent fuel from entering from said fuel intake passage side to said seal material side.

5. The high pressure fuel supply pump according to claim 4, characterized in that:

said check valve is open when a pump stops its operation.

6. The high pressure fuel supply pump according to claim 4, characterized in that:

said check valve is formed from an elastic member.

7. A high pressure fuel supply pump for an internal combustion engine comprising:

an electromagnetic operating mechanism controlled by a signal from a control unit of the internal combustion engine;

an engaging member provided in said electromagnetic operating mechanism to take an advanced first position and a withdrawn second position by a control signal from said control unit;

a valve body for opening and closing a fuel introducing port for communicating a cylinder of a pump with a low pressure side fuel passage; and a spring for biasing said valve body in a direction in which said fuel introducing port closes;

said high pressure fuel supply pump for an internal combustion engine configured as that when said engaging member is at the first position, said valve body is held at the position at which said fuel introducing port is opened; and when said engaging member is at the second position, said valve body is opened and closed due to a pressure difference between upstream and downstream of said valve body, wherein when fuel pressure in said pump cylinder exceeds a predetermined value after said valve body has been closed, said valve body prevents said engaging member from changing to the first position.

8. The high pressure fuel supply pump for an internal combustion engine according to claim 7;

wherein said engaging member has an elongated rod; and a ball member is mounted on the end on said valve body side of said rod portion.

9. The high pressure fuel supply pump for an internal combustion engine according to claim 8;

wherein said ball member is formed of a material having hardness equal to or more than $H_{RC}$ 30 in Rockwell hardness scale.

10. The high pressure fuel supply pump for an internal combustion engine according to claim 8, wherein said ball member is formed of stainless steel SUS440C in accordance with JIS Standard.

11. The high pressure fuel supply pump for an internal combustion engine according to claim 7, wherein said valve body is formed of a material having hardness more than $H_{RC}$ 30 in Rockwell hardness scale.

12. The high pressure fuel supply pump for an internal combustion engine according to claim 7, wherein said valve body is formed of stainless steel SUS440C in accordance with JIS Standard.

13. The high pressure fuel supply pump for an internal combustion engine according to claim 8, wherein said rod portion is formed of a magnetic material.

14. The high pressure fuel supply pump for an internal combustion engine according to claim 8, wherein said rod portion is formed of magnetic stainless steel SUS420J2 in accordance with JIS Standard.

15. The high pressure fuel supply pump for an internal combustion engine according to claim 7, wherein a member formed with said through hole is formed of stainless steel SUS440C in accordance with JIS Standard.

16. The high pressure fuel supply pump for an internal combustion engine according to claim 8, wherein said valve body and said ball member are formed of stainless steel SUS440C in accordance with JIS Standard, and said rod portion is formed of magnetic stainless steel SUS420J2 in accordance with JIS Standard.

* * * * *

UNITED STATES PATENT AND TRADEMARK OFFICE

CERTIFICATE OF CORRECTION

PATENT NO. : 6,631,706 B1
DATED : October 14, 2003
INVENTOR(S) : Hiroyuki Yamada et al.

It is certified that error appears in the above-identified patent and that said Letters Patent is hereby corrected as shown below:

Title page,
Item [22], PCT filing date, should read
-- [22] PCT Filed: Jun. 18, 1999 --

Signed and Sealed this

Eighth Day of June, 2004

JON W. DUDAS
*Acting Director of the United States Patent and Trademark Office*